US011371795B1

(12) United States Patent
Kempf et al.

(10) Patent No.: US 11,371,795 B1
(45) Date of Patent: Jun. 28, 2022

(54) PROJECTILE LAUNCHING DEVICE WITH SELF-TIMING AND WITHOUT CAM LEAN

(71) Applicant: Archery Innovators, Tiffin, IA (US)

(72) Inventors: James J. Kempf, Coralville, IA (US); Rex E. Isenhower, Mount Pleasant, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 17/235,385

(22) Filed: Apr. 20, 2021

Related U.S. Application Data

(63) Continuation-in-part of application No. 16/793,127, filed on Feb. 18, 2020, now Pat. No. 11,022,398.

(60) Provisional application No. 62/864,056, filed on Jun. 20, 2019.

(51) Int. Cl.
*F41B 5/12* (2006.01)
*F41B 5/10* (2006.01)

(52) U.S. Cl.
CPC ..... *F41B 5/105* (2013.01); *F41B 5/123* (2013.01)

(58) Field of Classification Search
CPC .... F41B 5/12; F41B 5/123; F41B 5/10; F41B 5/105
USPC ..... 124/25, 25.6, 900
See application file for complete search history.

(56) References Cited

U.S. PATENT DOCUMENTS 4,060,066 A * 11/1977 Kudlacek ..... F41B 5/10 124/90
4,457,288 A * 7/1984 Ricord ..... F41B 5/10 124/900
4,649,891 A * 3/1987 Bozek ..... F41B 5/123 124/25
4,917,071 A * 4/1990 Bozek ..... F41B 5/12 124/24.1
5,678,528 A * 10/1997 Hadley ..... F41B 5/12 124/25.5
6,470,870 B1 * 10/2002 Schaar ..... F41B 5/10 124/25.6
6,474,324 B1 * 11/2002 Despart ..... F41B 5/105 124/25.6
6,776,148 B1 * 8/2004 Islas ..... F41B 5/105 124/25.6
7,578,289 B2 * 8/2009 Norkus ..... F41B 5/10 124/44.5
7,637,256 B2 * 12/2009 Lee ..... F41B 5/10 124/25.6
7,823,572 B2 * 11/2010 Anderson ..... F41B 5/1469 124/25
7,938,109 B1 * 5/2011 Larson ..... F41B 5/10 124/25.6

(Continued)

*Primary Examiner* — Alexander R Niconovich
(74) *Attorney, Agent, or Firm* — Donald J. Ersler

(57) ABSTRACT

A projectile launching device includes self-timing without cam lean. The projectile launching device preferably includes a rail, a riser, two energy storing components, (such as two limbs), two cams, a launch string, and at least two cables. The ends of the launch string are attached to the two cams. Opposing ends of first and second cables are coupled to the first and second cams. A mid-segment of the first and second cables are slidably engaged with the first and second cable pulleys, respectively. The two cams are preferably built as mirror images of each other at a centerline of the rail. The two cams include a launch string track, having identical, but mirrored, upper and lower cable tracks.

22 Claims, 27 Drawing Sheets

(56) References Cited

U.S. PATENT DOCUMENTS

| | | | | |
|---|---|---|---|---|
| 8,037,876 | B1 * | 10/2011 | Yehle | F41B 5/10 124/25.6 |
| 8,387,603 | B2 * | 3/2013 | Darlington | F41B 5/105 124/25 |
| 8,651,095 | B2 * | 2/2014 | Islas | F41B 5/123 124/900 |
| 8,826,894 | B1 * | 9/2014 | Darlington | F41B 5/105 124/900 |
| 8,833,349 | B2 * | 9/2014 | Park | F41B 5/0094 124/25.6 |
| 9,234,719 | B1 * | 1/2016 | Kempf | F41B 5/12 |
| 9,243,861 | B1 * | 1/2016 | Kempf | F41B 5/12 |
| 9,273,921 | B2 * | 3/2016 | Koch | F41B 5/10 |
| 9,297,604 | B1 * | 3/2016 | Sidebottom | F41B 5/105 |
| 9,377,267 | B1 * | 6/2016 | Kempf | F41B 5/105 |
| 9,494,379 | B2 * | 11/2016 | Yehle | F41B 5/10 |
| 9,513,080 | B1 * | 12/2016 | Kempf | F41B 5/1411 |
| 9,759,509 | B1 * | 9/2017 | Kempf | F41B 5/123 |
| 9,829,268 | B1 * | 11/2017 | Kempf | F41B 5/105 |
| 9,879,938 | B1 * | 1/2018 | Isenhower | F41B 5/123 |
| 10,048,036 | B1 * | 8/2018 | Kempf | F41B 5/105 |
| 10,139,191 | B1 * | 11/2018 | Kempf | F41B 5/123 |
| 10,175,023 | B2 * | 1/2019 | Yehle | F41B 5/123 |
| 10,254,073 | B2 * | 4/2019 | Yehle | F41B 5/143 |
| 10,267,592 | B2 * | 4/2019 | Bartels | F41B 5/123 |
| 10,386,151 | B2 * | 8/2019 | McPherson | F41B 5/123 |
| 10,393,470 | B1 * | 8/2019 | Popov | F41B 5/105 |
| 10,458,742 | B1 * | 10/2019 | Kempf | F41B 5/123 |
| 10,473,418 | B2 * | 11/2019 | Shaffer | F41B 5/123 |
| 10,514,226 | B2 * | 12/2019 | Shaffer | F41B 5/105 |
| 10,767,956 | B2 * | 9/2020 | Popov | F41B 5/123 |
| 10,989,492 | B1 * | 4/2021 | Kempf | F41B 5/105 |
| 11,112,205 | B1 * | 9/2021 | Kempf | F41B 5/123 |
| 2008/0251058 | A1 * | 10/2008 | Colley | F41B 5/123 124/25 |
| 2011/0041820 | A1 * | 2/2011 | Stanziale | F41B 5/105 124/25 |

* cited by examiner

PROJECTILE LAUNCHING DEVICE WITH SELF-TIMING AND WITHOUT CAM LEAN

CROSS-REFERENCES TO RELATED APPLICATIONS

This is a continuation-in-part patent application taking priority from patent application Ser. No. 16/793,127, filed on Feb. 18, 2020. Patent application Ser. No. 16/867,899, filed on May 6, 2020 and patent application Ser. No. 16/793,127 are hereby incorporated by reference in their entirety.

BACKGROUND OF THE INVENTION

1. Field of the Invention

The present invention relates generally to archery and more specifically to a shooting bow with a unique cable arrangement, which allows a portion of first and/or second cables to be slidably engaged to a first and second pulley, and the ends of each cable are anchored to the same cam. This arrangement enables the device to have self-timing. The present invention may alternately use components other than flexible limbs for storing energy prior to launching the projectile. The present invention may be used in a reverse-draw style or conventional-draw style crossbow, having the bowstring located between the axles of the cams and the string latch mechanism, or having the string located forward the cam axles, wherein the cables are retained, at least partially, in a static position relative to the longitudinal centerline of the crossbow and are always within about thirty degrees of the line drawn from a first cam axle to a second cam axle.

2. Discussion of the Prior Art

Historically, archery bows and crossbows have been used for war, survival, sport, and recreation. A specific component of a compound style shooting bow are the cables. Typically, each cable includes a power end and a control end. The manner in which the cables interact with the cams and limbs of the bow is of particular importance. Typically, the power end of the cable is coupled to the cam on one limb, and the control end of the cable is often coupled to the opposite limb or opposite cam. A very good way to accomplish efficiency is through a binary cam system, wherein the cables are connected to opposing cams, and as one of the cams wraps the cable on the power track, the opposite cam pays out cable from the control track. While all of these methods work to some extent, all have significant issues with performance related to cam lean, and/or assembly and cost. Due to the crossing of cables and the need to keep the cables from interfering with the flight of the arrow, the cables often are off-angle, which in turn creates twisting and torque in a cam axle, thus creating cam lean.

U.S. Pat. No. 4,457,288 to Ricord discloses a cam lever compound bow, where a bow utilizes single string wrapping pulleys journaled to the ends of the bow limbs, and the ends of the string are coupled to a cam device mounted upon the bow riser. Although, this method does remove the problem of the cables being in the way, it is very inefficient, and timing issues from one limb to the other is a factor. Patent no. 7637256 to Lee discloses a compound bow, which provides a shooting bow that removes the issue of cables interfering with the flight of the arrow. However, the inefficient use of tensioning devices severely limits the potential of this device. Patent no. 8651095 to Islas discloses a bowstring cam arrangement for compound crossbow, which provides a method of removing the cables from the path of the string. Patent no. 9494379 to Yehle discloses a crossbow, where Yehle relies on four cables. Issues are created by having separate cables above and below the string track on each cam. If the cables are not of exact length, or if the upper cable stretches more than the lower cable, or visa-versa, the cables must be adjusted by the user to stay in time with each other. Timing of the cables can be a time consuming and a very difficult process. Patent no. 9759509 to Kempf teaches a cable configuration wherein the cables are anchored to the cams, which allows for self-timing. More recently, Hoyt introduced a cable configuration wherein the ends of the cable are anchored to the cam, and a central portion of the cable passes through a sleeve. This system is beneficial, however still lacks the smooth passage of the cables to self-time, further there is no provision for the cams to rotate more than about 180 degrees. The present invention deals with the manner in which the cables are coupled to the cams of the bow or crossbow.

The additional disclosure teaches a preferred optimal cabling arrangement wherein the power cables of the crossbow are no more than 15 degrees off parallel with a line drawn between a first cam axle and a second cam axle when the crossbow is un-cocked, and no more than 15 degrees off parallel with a line drawn between a first cam axle and a second cam axle when the bow is cocked. Such a cable arrangement allows for minimal parasitic loss of energy during the release cycle of the crossbow.

Accordingly, there is a clearly felt need in the art to provide a shooting bow, which allows a mid-portion of first and second cables to be slide-ably engaged on a first and second pulley, and the ends of the cables are coupled to the same cam, respectively, wherein the cam is allowed to rotate at least 200 degrees, up to at least 360 degrees. Historically with all prior art, cams that rotate more than 200 degrees up to about 300 degrees do not require the use of a wider cable track, as the cables are not required to stack upon themselves. The cables do not cross the centerline of the shooting bow. Additionally, the cams are allowed to rotate 360 degrees due to a wider upper and lower cable track, or alternately a divided helical cable track, which allows the cable to wrap adjacent to itself.

SUMMARY OF THE INVENTION

The present invention provides a self-timing cam and cable configuration for a projectile launching device. The present invention includes a pair of cables, wherein both ends of the same cable anchors to the same cam(s), and also reduces or eliminates cam lean. The projectile launching device with self-timing and without cam lean (projectile launch device) may be applied to either a crossbow or vertical bow. The projectile launch device preferably includes a first cam, a second cam, a launch string and two cables, collectively known as a harness system. This configuration allows opposing ends of a first cable to be anchored to a first cam, and opposing end of a second cable to be anchored to a second cam. Preferably, the first and second cables do not cross a centerline of the shooting bow. In a second preferred embodiment, the projectile launching device preferably includes a string latch housing, a bow riser, a rail, a first energy storing device (such as a first limb), a second energy storing device (such as a second limb), a first cam, a second cam, at least one bowstring, and two cables.

The term "limb" may refer to what are known as solid limbs, split-limbs, tube-limbs, or any other flexible energy storing component. The bow riser is enjoined with the rail. One end of the first limb extends from a first end of the bow riser and one end of the second limb extends from a second end of the bow riser. The first cam is pivotally retained on the first limb and the second cam is pivotally retained on the second limb. A first end of the launch string is retained by the first cam and a second end of the launch string is retained by the second cam. On an alternative embodiment, a first set of first and second cable posts are located on a first side of a centerline of the rail and a second set of first and second cable posts are located on a second side of the centerline of the rail. These cable posts may be used to anchor a secondary set of cables which support the cable pulleys. The first cam includes a first cam launch string track, an upper first cam cable track, located above the launch string track, and a lower first cam cable track, located below the launch string track. The second cam includes a second cam launch string track, an upper second cam cable track, located above the launch string track, and a lower second cam cable track, located below the launch string track. The first set of first and second cable posts are located above the plane of the launch string, and the second set of first and second cable posts are located below the plane of the launch string.

A first end of the first cable is coupled to the first cam first cable post; a segment of the first cable before a middle of the first cable partially engages the first cable pulley; the middle of the first cable partially wraps the first cable track; a segment of the first cable after the middle of the first cable partially engages the first cam second cable track; and a second end of the first cable is coupled to the first cable second cable post. A first end of the second cable is coupled to the second cam first cable post; a segment of the second cable before a middle of the second cable partially engages the second cam first cable track; the middle of the second cable partially wraps the second cable pulley; a segment of the second cable after the middle of the second cable partially engages the second cam second cable track; and a second end of the second cable is coupled to the second cable second cable post.

When the launch string is drawn from a rest position to a ready to fire position, the first cam rotates in a first direction and the second cam rotates in a second direction. As the first and second cams rotate, the launch string is unwound from the first and second launch string tracks. Simultaneously, the first and second cables wind into the first and second cable tracks of the first and second cams.

A unique feature of the present invention is that both ends of the first and second cables are firmly fixed to the same cam, and the middle portions "float" or slide relative to the first and second cable pulleys. The first and second cables are of one piece, and as the cable stretches, it self-centers itself about the cable pulleys. The term "pulley" is used as a general term for a component or feature engaging the cables to allow for the smooth transition of a segment of the cables from above the bowstring to below the bowstring, from a first side of the cams to a second side of the cams, wherein the component or feature (the cable retention transition) is coupled with the frame, structure, support, barrel, or riser, providing a slide-able retention position for the segment of the cables. The cable retention transition preferably has a curved shape, which the cable makes contact with, but other shapes may also be used.

Another unique feature of the present invention is the ability of the cam to rotate a full 360 degrees, such that as the cams are rotating, the upper and lower cable portions wrap the cable cams.

In a preferred embodiment, the launch string may be releasably retained in the ready-to-fire position by mechanisms known as a string latch assembly or a string release.

In a first preferred alternative embodiment, the launch string may be held in the ready-to-fire position and released by the users' fingers.

In a second preferred alternative embodiment, a rail-less crossbow design may be used.

In a third preferred alternative embodiment, the same harness system configuration may be used on projectile launching devices utilizing energy storing components other than flexible limbs. These other types of energy storing components include spring(s), hydraulics, or pressurized cylinder(s).

In the current disclosure, a conventional-draw crossbow having conventional cams or a reverse draw style crossbow having non-inverted cams having the bowstring unwind from the rear of the cams, and the cables are engaged with the cams forward the cam axles. There is only one cable per cam, each cable having a first end and a second end, a first end adjacent segment and a second end adjacent segment, a first span, a mid-segment, and a second span. Both ends of the first cable are anchored to the first cam, and both ends of the second cable are anchored to the second cam. The mid segment of the first cable engages a first cable pulley, and the mid segment of the second cable engages a second cable pulley. The first end adjacent segment engages a first cable track on a first side of the first cam and a second end adjacent segment engages at the second cable track on a second side of the cam.

Alternately, the cable ends may anchor adjacent the longitudinal center line of the projectile launching device, and a mid-section of the cable passes through the cam. A first end of the cable is above the bowstring, and the second end of the cable is below the bowstring. Bowstring support pulleys may be between the cable anchors, in front of the cable anchors, or behind the cable anchors. It is preferred that rotating pulleys be used intros configuration, however any smooth rounded surface will suffice.

As a crossbow is being cocked, the bow limbs are moved by the cams, strings, and cables. The cam axles move in an arc, the arc is mirrored from side to side. The cables input great forces on the cams, and depending on the departure angle of the cables relative to the cam axles, unnecessary parasitic loss of energy can be caused when the crossbow is fired and the bow limbs release stored energy. Further, the static load placed on the limbs can be negatively impacted on the limbs where the cam axles are coupled with the limbs.

For clarity, the word coupled is being defined as a way to connect an object, such as a bowstring or cable, with another object, be it directly or indirectly, such as directly to a post or pulley, or indirectly as in from the end of a string or cable, to an intermediate object, and then to a limb or axle.

Though the term "pulley" has been used through out the application, "pulley" references the component used to slideably retain and transition the cables from a first side of the bowstring track to a second side of the bowstring track, any component fulfilling the same function may be utilized and may or may not be known as a pulley in the traditional sense, and may or may not function as a rotatable pulley, as rotation of the component is not a prerequisite to retention and transition of said the cables.

The term "rail" is used as a general term describing an elongated component that directly or indirectly supports the front of an arrow. "Rail-less" crossbows still have an elongated component that is coupled with a riser or other structure, wherein the elongated component directly or indirectly supports the front of an arrow.

The term "slidably" as used in the application as to reference how a segment of the cables engage the cable "pulleys", in that the mid-segment of the cable is retained by, and not fixed to, the "pulley". The first and second ends of the cables are anchored in a fixed position relative to each other, preventing the mid-segment of the cables from actually moving back and forth, or sliding.

Accordingly, there is a clearly felt need in the art for a projectile launching device with no cam lean, having a first cam, a second cam, a launch string and at least two cables, collectively known as a harness system, where both ends of the same cable are rigidly attached to the same cam, and the mid-portion of each cable at least partially wraps a cable pulley.

Further, there is a clearly felt need in the art to provide a shooting bow, which allows a mid-portion of first and second cables to be slidably engaged on a first and second pulley, and the ends of the cables are coupled to the same cam, respectively, wherein the cam is allowed to rotate at least 200 degrees up to about 300 degrees, and up to at least 360 degrees. Historically with all prior art, cams that rotate more than 200 degrees up to about 300 degrees do not require the use of a wider cable track, as the cables are not required to stack upon themselves. The cables do not cross the centerline of the shooting bow.

Additionally, there is a need in the art to provide a projectile launching device which allows the bowstring to begin the draw cycle not in contact with a supporting pulley, come in contact with a support pulley, and stay in contact with the support pulley through the remainder of the draw cycle, including while in the cocked position. There is also need in the art for a projectile launching device which allows the bowstring to begin the draw cycle in contact with supporting pulleys, and stay in contact with the supporting pulleys through the entire draw cycle, including while the bowstring is in the cocked position. It is most advantageous to have the bowstring in contact with support pulleys when the bowstring is at rest, especially when the center to center distance between the axles is less than about six inches, or less than about 5 inches, or less than about four inches, or less than about three inches. The shorter the distance between the center of the support pulleys is, the less the bowstring is allowed to oscillate, which translates to smoother post-shot vibration.

Finally, the cams may be allowed to rotate up to 360 degrees due to a wider upper and lower cable track, or alternately a divided helical cable track, which allows the cable to wrap adjacent to itself.

These and additional objects, advantages, features and benefits of the present invention will become apparent from the following specification.

The additional disclosure teaches a preferred optimal cabling arrangement wherein the power cables of the crossbow are parallel with the bowstring when the crossbow is in the un-cocked position and no more than 30 degrees off parallel when the crossbow is cocked, or no more than 15 degrees off parallel with a line drawn between a first cam axle and a second cam axle when the crossbow is un-cocked, and no more than 15 degrees off parallel with a line drawn between a first cam axle and a second cam axle when the bow is cocked, or an alternative of an angle no more than 30 degrees total movement of the cable during the draw cycle and release cycle. Such a cable arrangement allows for minimal parasitic loss of energy during the release cycle of the crossbow.

DETAILED DESCRIPTION OF THE PREFERRED EMBODIMENTS

Figure 1A:
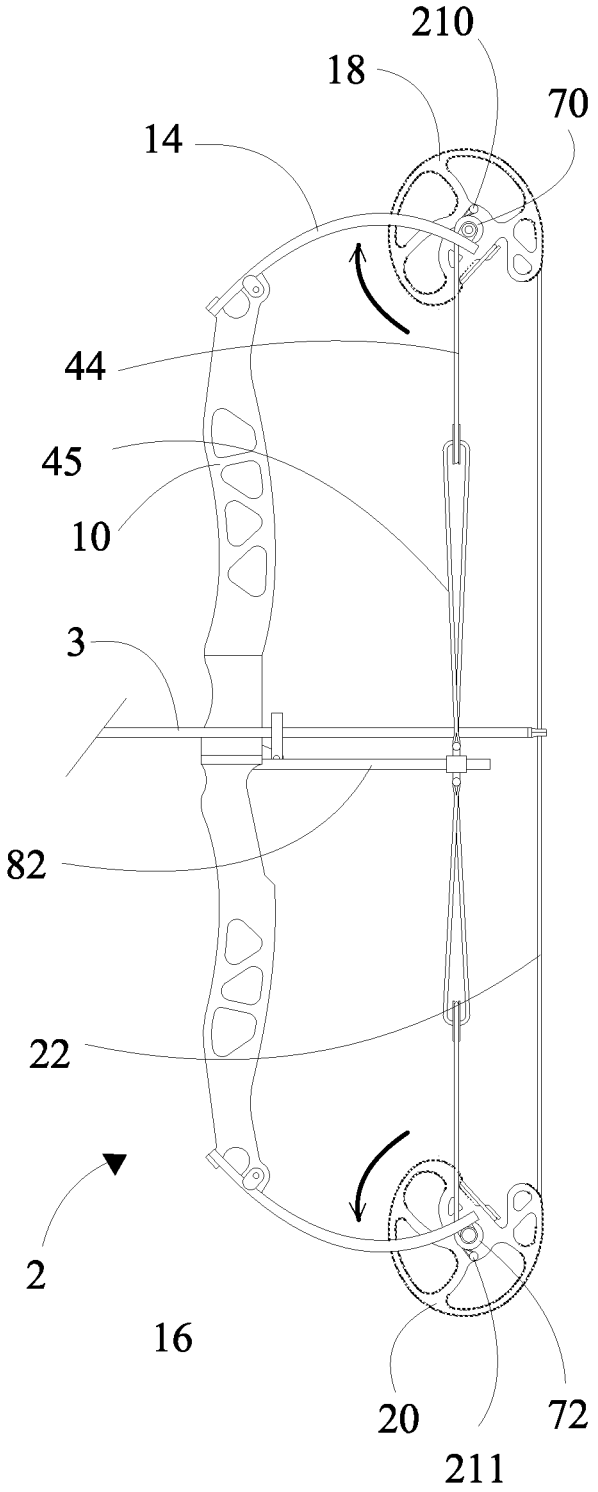
FIG. 1A is a partial rear view of a vertical bow of the present invention, having a first and second cam, a first and second cable, and a string, wherein opposing ends of the same cable are anchored to the same cam, and a mid-portion of the cables partially wrap a cable pulley of the present invention.
Figure 1B:
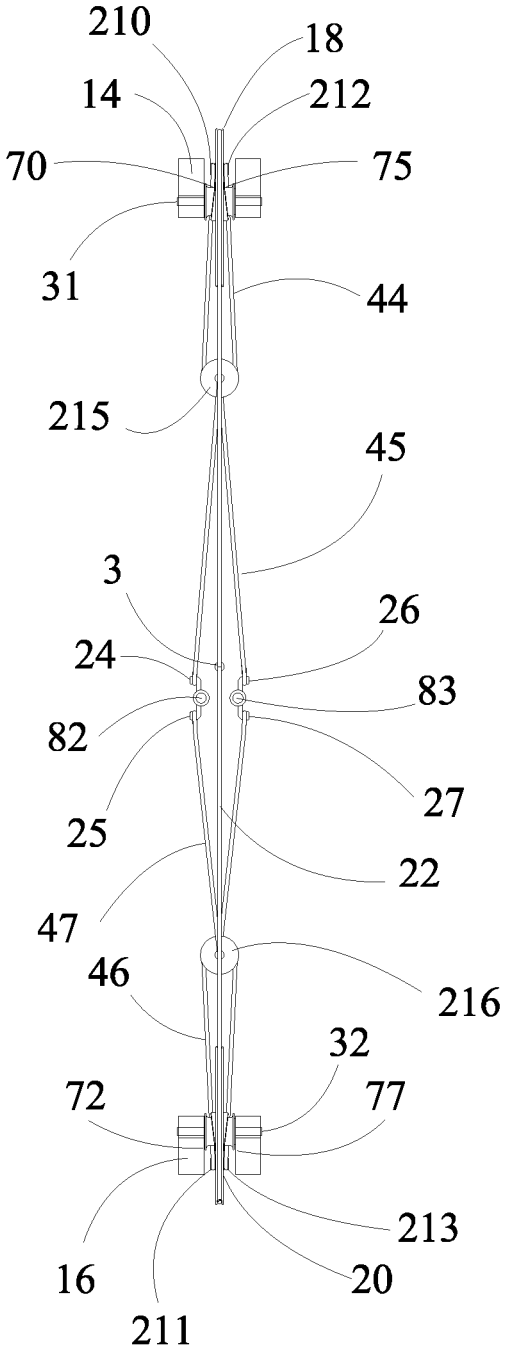
FIG. 1B is a partial rear view of a vertical bow of the present invention, having a first and second cam, a cable, and a string, wherein opposing ends of the same cable are anchored to the same cam, and a mid-portion of the cables partially wrap a cable pulley of the present invention.

With reference now to the drawings, FIGS. 1, 1A and 1B show views of a vertical bow-type projectile launching device 2. The projectile launching device 2 preferably includes a bow riser 10, a first limb 14, a second limb 16, a first cam 18, a second cam 20 and a launch string 22. One end of the first limb 14 is attached to a first end of the bow riser 10 and one end of the second limb 16 is attached to a second end of the bow riser 10. The first cam 18 is pivotally retained on an opposing end of the first limb 14 with a first axle 31 and the second cam 20 is pivotally retained on an opposing end of the second limb 16 with a second axle 32.

With more specific reference to FIG. 1A, the disclosed embodiment illustrates a vertical bow 2 having a first cable 44 and a second cable 46, wherein a first end of the first cable 44 is anchored to a first cable first post 210, and a second end of the first cable 44 is anchored to a first cable second cable post 212. A first end of the second cable 46 is anchored to a second cable first cable post 211 and a second end of the second cable 46 is anchored to a second cable second post 213. A first cable spanner bar 82 is coupled to the riser 10 on a first side of the launch string 22, and a second cable spanner bar 83 is coupled to the riser 10 on a second side of the launch string 22. The cable spanner bars 82 and 83 displace the first and second pulley mounting cables 45 and 47 a distance away from the launch string 22 to allow clearance for an arrow 33.

More specifically referring to FIG. 1B, the disclosed embodiment illustrates a vertical bow 2. The first spanner bar 82 is coupled to the riser 10 on the first side of the launch string 22, and the second spanner bar 83 is coupled to the riser 10 on the second side of the launch string 22. A first end of a first cable 44 is coupled to a first cam 18 first cable anchor 210, a mid-segment of said first cable partially wraps a first cable pulley 215, and a second end of said first cable anchors to a first cam 18 second cable post 212. A first end of a second cable 46 is coupled to a second cam 20 first cable anchor 211, a mid-segment of said second cable 46 partially wraps a second cable pulley 216, and a second end of said second cable 46 anchors to a second cam 18 second cable post 213. The first cable pulley 215 is coupled to a first pulley mounting cable 45 and first and second first pulley mounting cable post 24 and 26. The second cable pulley 216 is coupled to a second pulley or transition mounting cable 47 and first and second second-pulley mounting cable post 25 and 27.

Figure 2A:
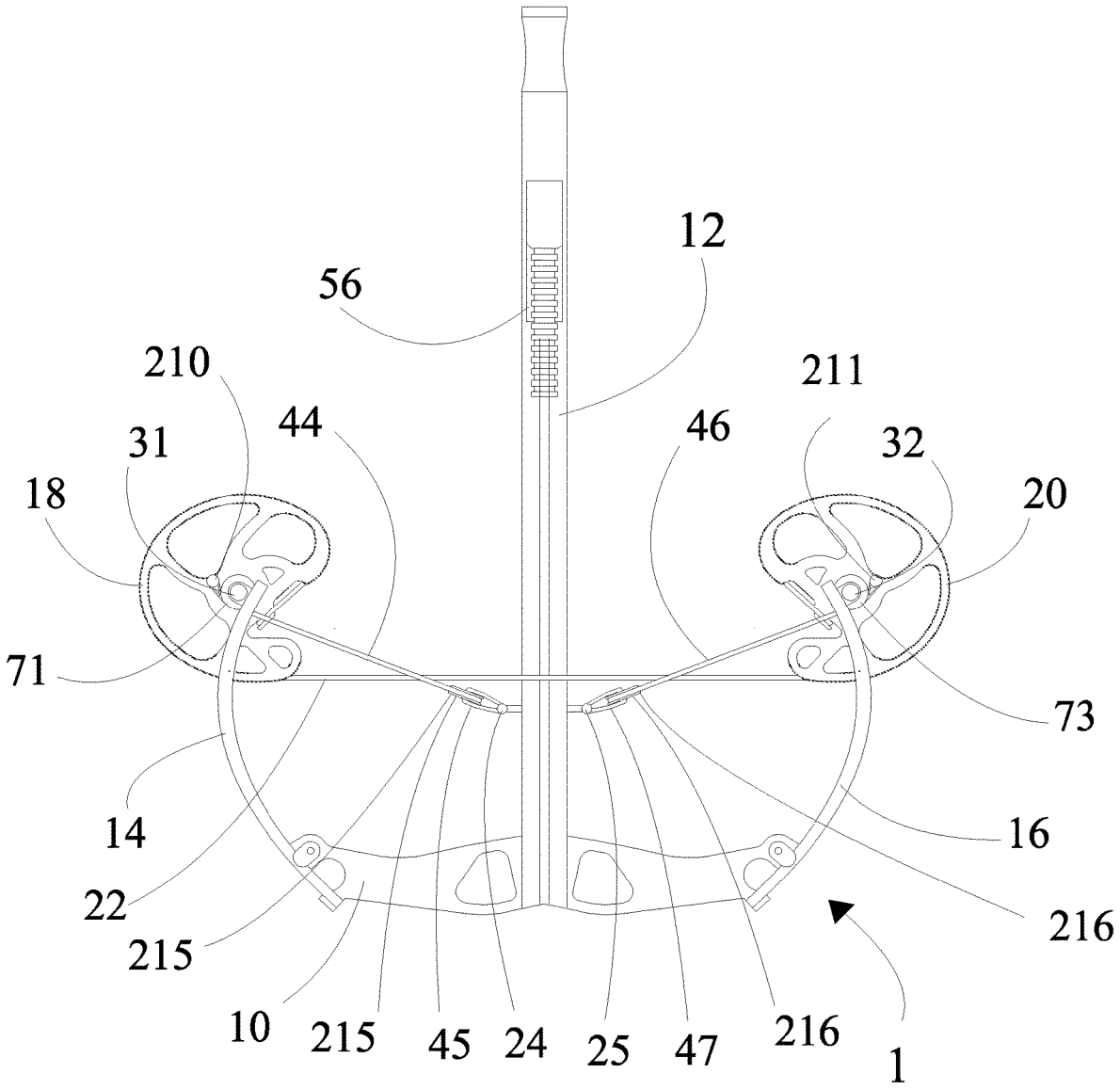
FIG. 2A is a top view of a conventional limb crossbow with inverted cams of the present invention in an at-rest position, having first and second cams; first and second cables; and a string, wherein opposing ends of the same cable are anchored to the same cam, and a mid-portion of the cables partially wrap a cable pulley of the present invention.
Figure 2B:
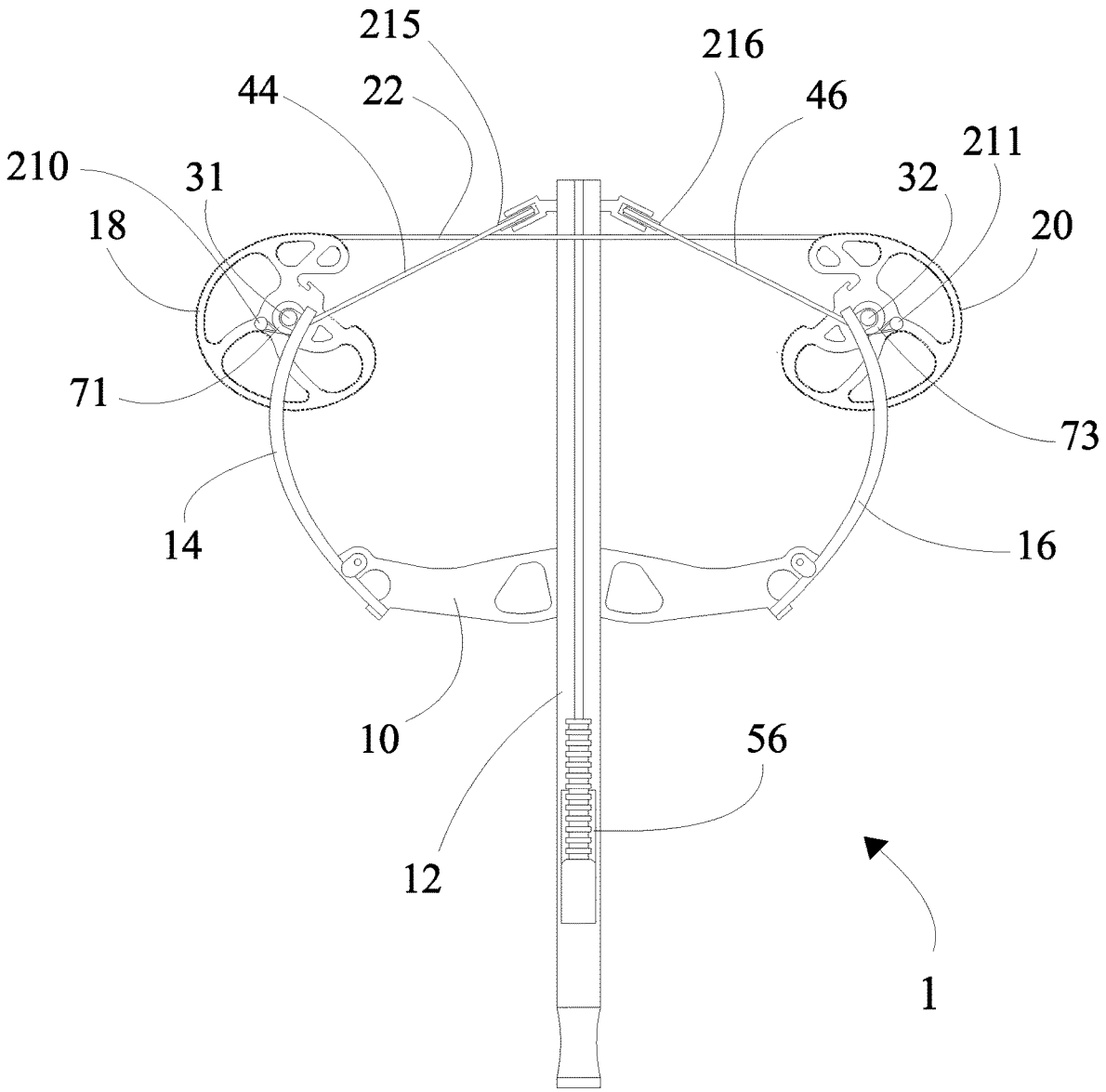
FIG. 2B is a top view of a reverse draw crossbow of the present invention in an at-rest position, having first and second cams; first and second cables; and a string, wherein opposing ends of the same cable are anchored to the same cam, and a mid-portion of the cables partially wrap a cable pulley—of the present invention.

FIGS. 2A and 2B illustrate a crossbow 1 of the current invention. The bow riser 10 may be joined with the rail 12 in any method known to join two pieces, as well as the rail 12 and the riser 10 being formed together as a single unit. The projectile launching device 1 preferably includes the riser 10, the rail 12, a first limb 14, a second limb 16, a first cam 18, a second cam 20 and a launch string 22.

A first end of the first limb 14 is coupled to a first end of the bow riser 10 and a first end of the second limb 16 is coupled to a second end of the bow riser 10. The first cam 18 is pivotally retained on an opposing end of the first limb 14 and the second cam 20 is pivotally retained on an opposing end of the second limb 16. The crossbow 1 includes a first cable 44 and a second cable 46. With reference to FIGS. 2A and 2B, the first end of the first cable 44 is anchored to the first cable first post 210, and the second end of the first cable 44 is anchored to the first cam second cable post 212. The first end of the second cable 46 is anchored to the second cable first cable post 211, and the second end of the second cable 46 is anchored to the second cable second post 213.

The first end of the first pulley mounting cable 45 is coupled to a first cable pulley or the first cable retention transition 215 and a first pulley mounting cable first and second post 24 and 26 (26 not shown). The first end of the second pulley mounting cable 47 is coupled to a second cable pulley or the second cable retention transition 216 and a second pulley mounting cable first and second post 25 and 27 (27 not shown).

Figure 2C:
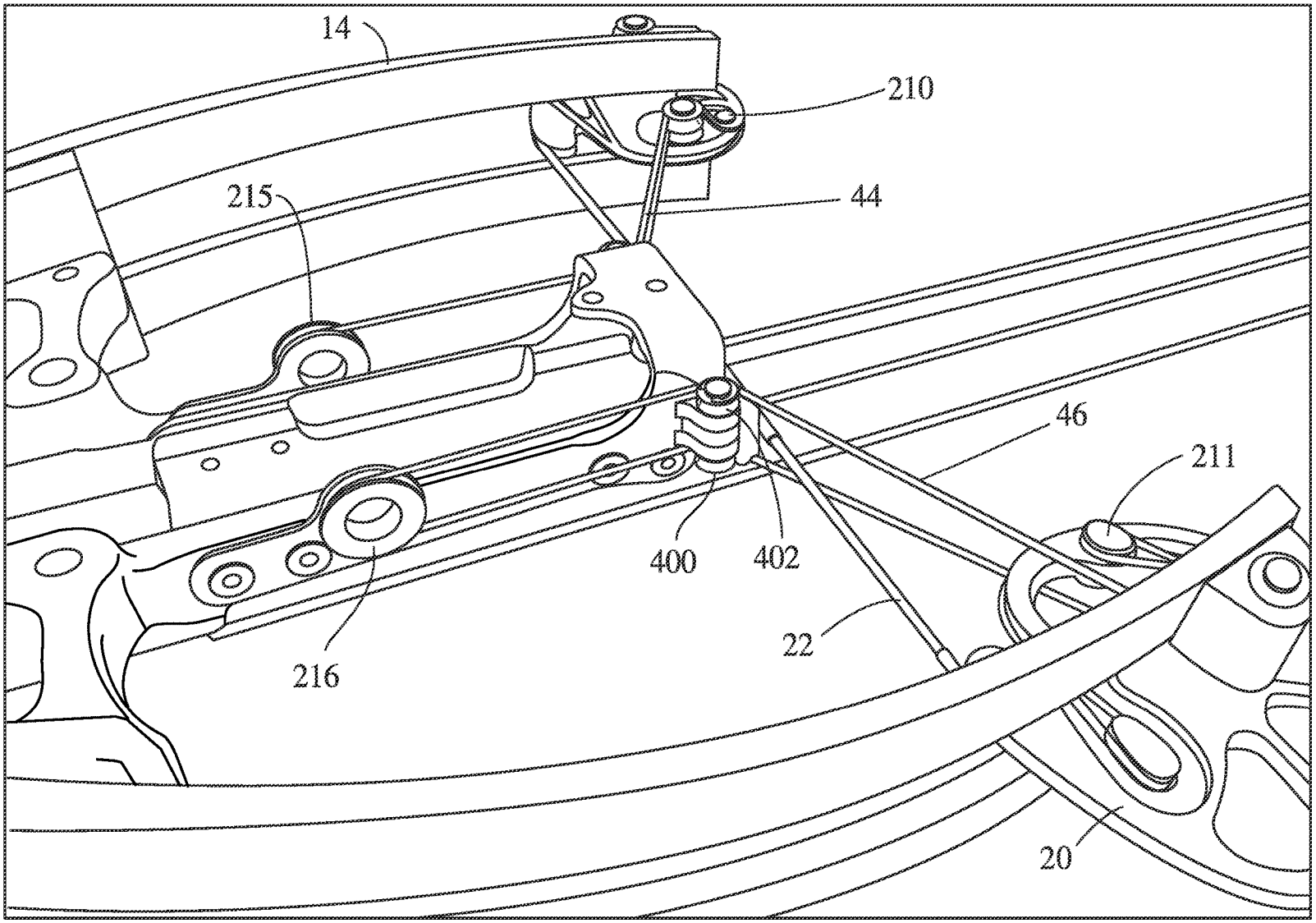
FIG. 2C is a perspective view of a crossbow with the string at rest where each end of a first cable is anchored to a first cam, each end of a second cable is anchored to a second cam, and first and second directional transition components are located between the cams and the cable pulley of the present invention.
Figure 2D:
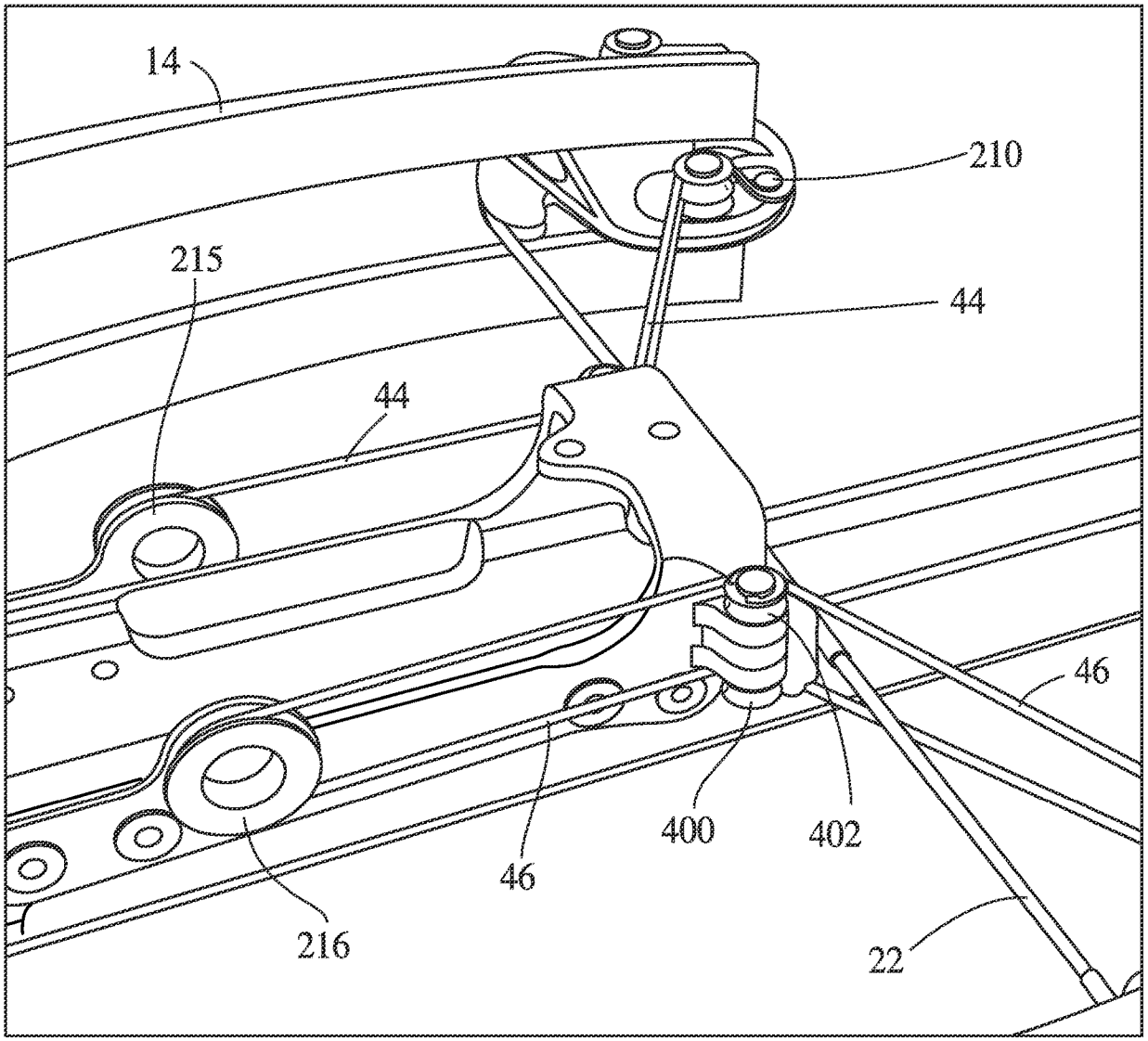
FIG. 2D is a first close up view of FIG. 2C of the present invention.
Figure 2E:
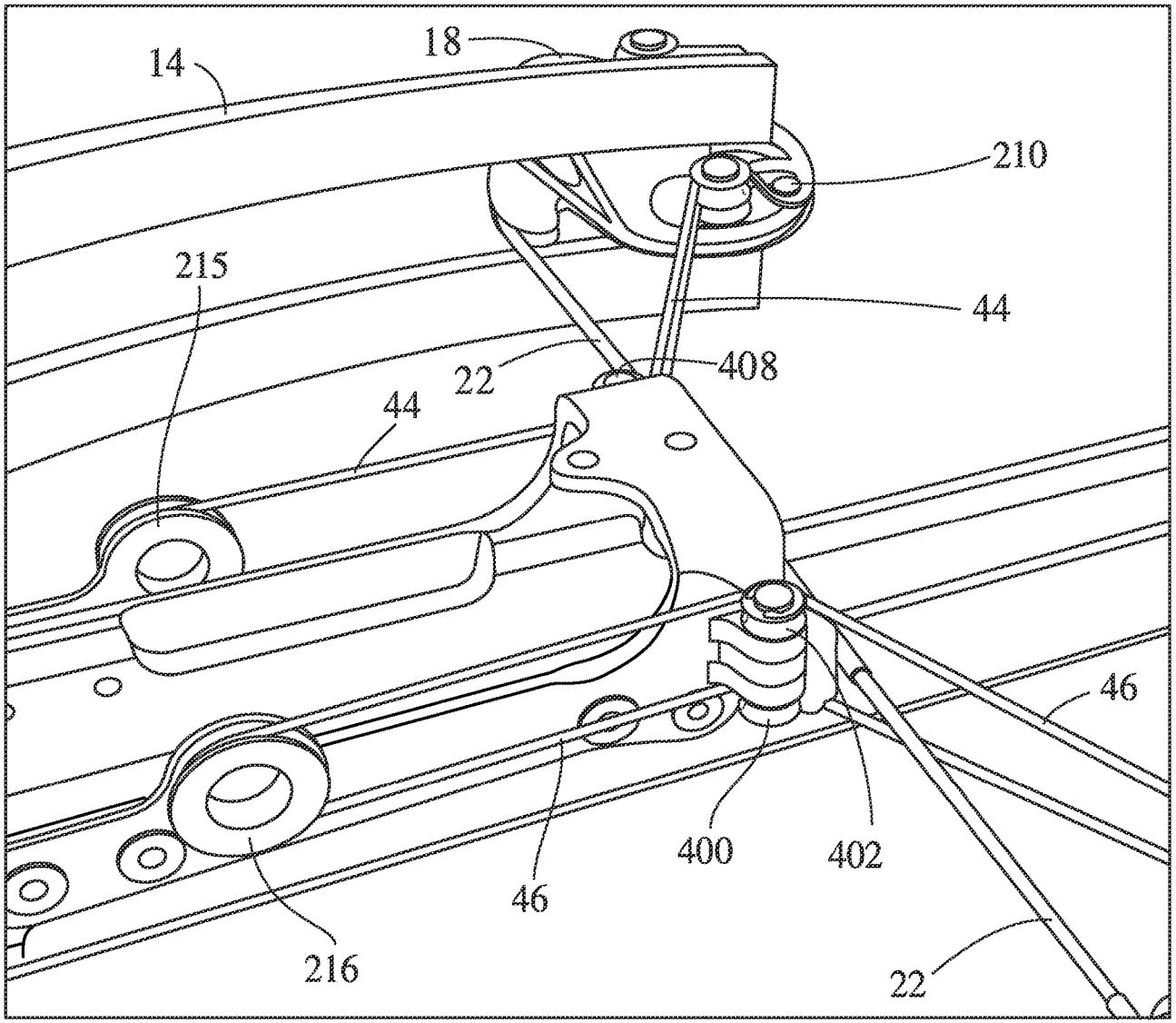
FIG. 2E is a second close up view of FIG. 2C of the present invention.

FIGS. 2C-2E, disclose a first and a second cable 44 and 46, each cable having a first end and a second end; and a first and a second cam 18 and 20. The first end of the first cable 44 is anchored to the first cam 18 and engages a first cable track of the first cam 18; the first cable 44 then spans to a first directional transition 408, (A component that alters the direction of the span. The directional transition may be of any smooth-surface that retains the cable.) The first cable 44 then spans to and is retained by a first cable pulley 215, the first cable 44 then spans to a second directional transition (not shown), then spans to engage a second cable track of the first cam 44, and the second end of the first cable 44 is anchored to the first cam 18. The first end of the second cable 46 is anchored to the second cam 20 and engages a first cable track of the second cam 20; the second cable 46 then spans to a third directional transition 402, then spans to and is retained by a second cable pulley 216, the second cable 46 then spans to a fourth directional transition 400, then spans to engage a second cable track of the second cam 20, and the second end of the second cable 46 is anchored to the second cam 20. The first and second directional transitions are a mirror of the third and fourth directional transitions 400, 402. The use of directional transitions allows for flexibility in design, and management of structural forces that would be impossible without them.

Figure 3:
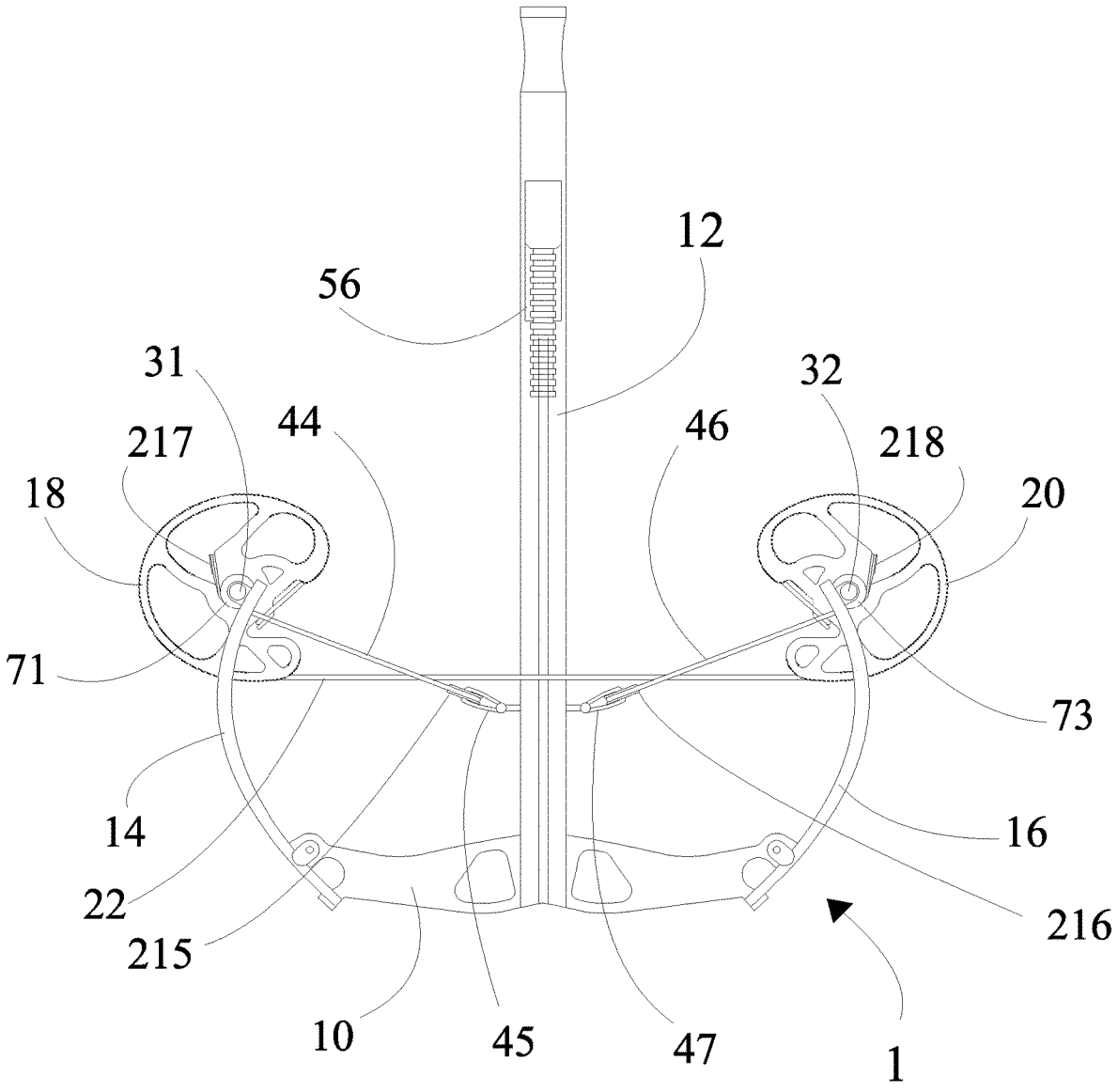
FIG. 3 is a top view of a conventional limb crossbow with inverted cams of the present invention in an at-rest position, having first and second cams; first and second cables; and a string, wherein opposing ends of the same cable are anchored to the same cam, and a mid-portion of the cables partially wrap a cable pulley of the present invention.
Figure 3A:
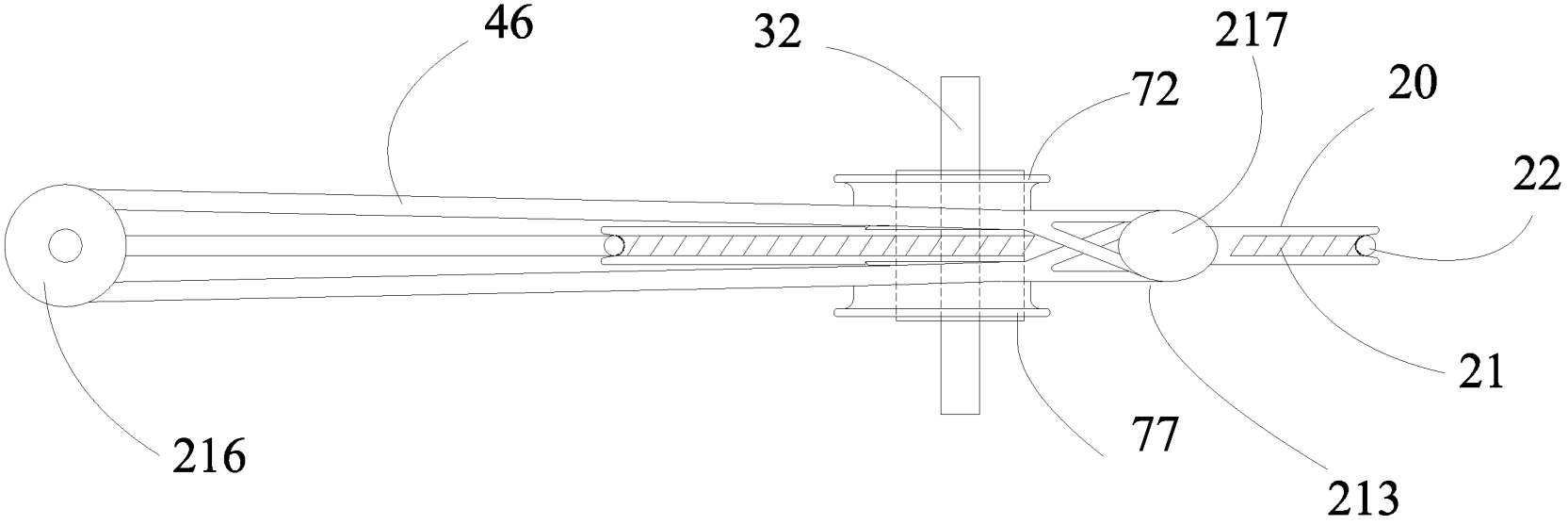
FIG. 3A is a side cut-away view of a second multi-piece cam with non-circular cable tracks of the present invention, having an upper and lower cable track that is at least twice as wide as the width of the cables; opposing ends of the second cable are anchored to the same post on the second cam, and a mid-portion of said second cable partially wraps a second cable pulley, a string and second cable are illustrated with the cam of the present invention.

With reference to FIG. 3, a similar crossbow is shown as relates to FIG. 2, however the first and second ends of the first cable 44 are anchored to a first cam single cable post 217 on a first cam 18, and the first and second ends of the second cable 46 are anchored to a second cam single cable post 218 on the second cam 20. FIG. 3A shows a partial cross section view of the crossbow of FIG. 3, wherein the first and second ends of cable 46 are anchored to a first cam 18 first cam single cable post 217.

Referring to FIGS. 4A-4J, the first cam 18 includes a first launch string track 19, a first cam upper cable track 40, a first cam launch string post 61, and a first cam lower cable track 41. A first end of the launch string 22 is retained by the first cam launch string post 61; a portion of the span of the launch string 22 at least partially wraps around the first cam 18 in the first cam launch string track 19; a portion of the span of the launch string 22 at least partially wraps the second cam 20 in the second cam launch string track 21, and a second end of the bowstring 22 is retained by the second cam launch string post 63.

The first end of the first cable 44 is coupled to the first cam first cable post 210; a segment of the first cable 44 partially engages the first cam upper cable track 40; the middle of the first cable 44 is retained by the first cable pulley 215 (not shown); a segment of the first cable 44 partially engages the first cam lower cable track 41; and the second end of the first cable 44 is coupled to the first cam second cable post 212. The first end of the second cable 46 is coupled to the second cam first cable post 211; a segment of the first cable 46 partially engages the second cam upper cable track 40; the middle of the first cable 46 is retained by the 216 (not shown); a segment of the second cable 46 partially engages the second cam lower cable track 41; and the second end of the second cable 46 is coupled to the second cam second cable post 213.

Figure 6A:
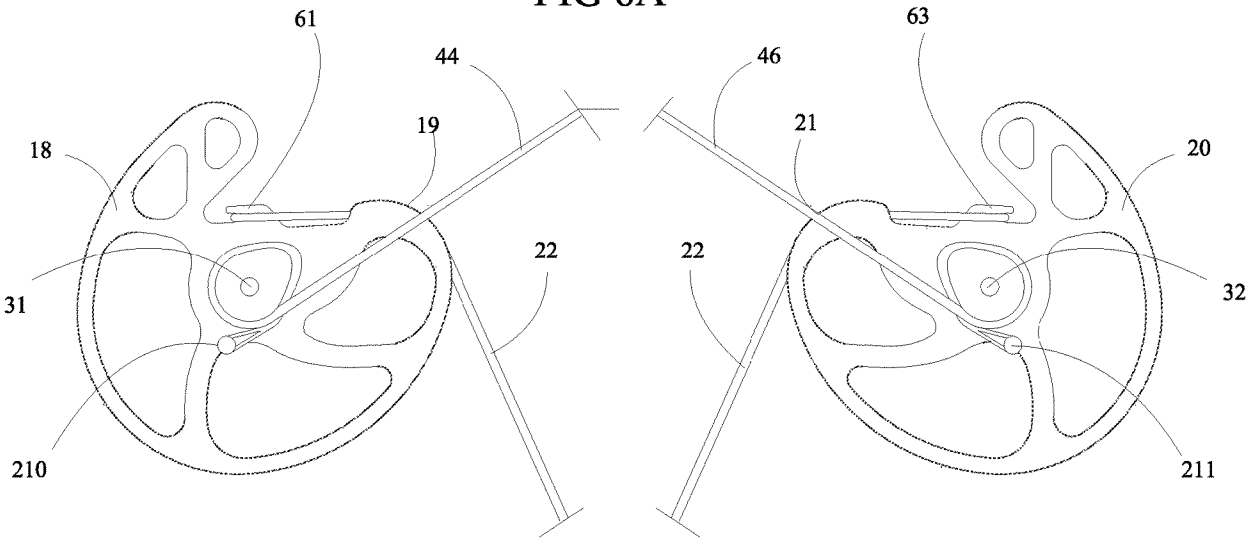
FIG. 6A is a top view of first and second multi-piece cams with non-circular cable tracks of the present invention; having an upper and lower cable track, modules have been removed for illustrative purposes; a string and cable are illustrated with the cam in a drawn position of the present invention.
Figure 6B:
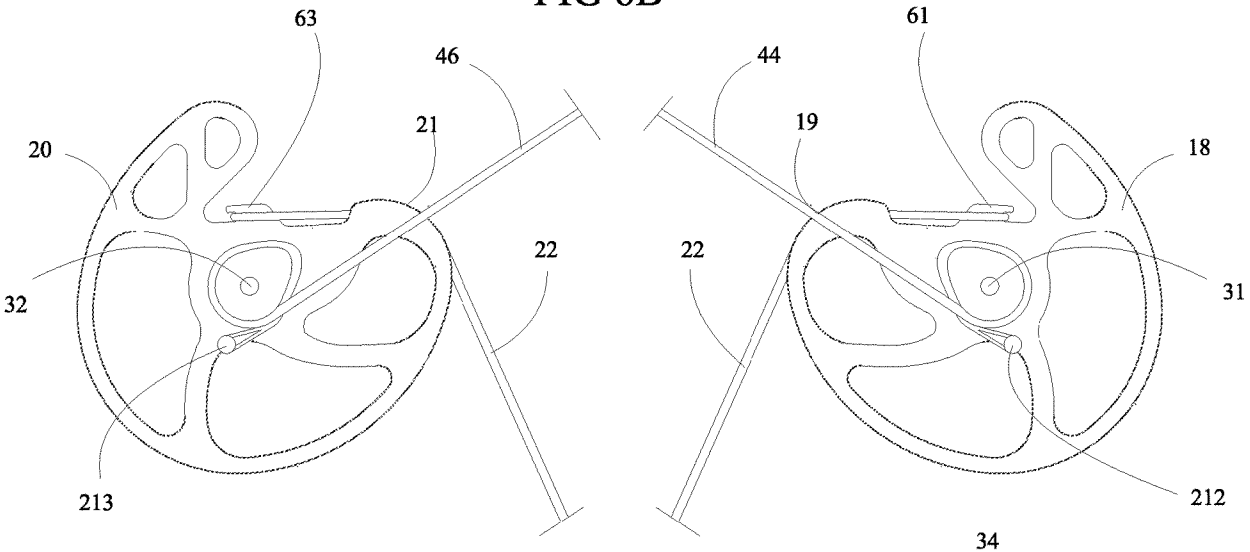
FIG. 6B is a bottom view of first and second multi-piece cams with non-circular cable tracks of the present invention, having an upper and lower cable, modules have been removed for illustrative purposes; a string and cable are illustrated with the cam in a drawn position of the present invention.

With reference to FIGS. 6A and 6B, when the launch string 22 is drawn from a rest position to a ready to fire position, the first cam 18 rotates in a first direction, and the second cam 20 rotates in a second direction. As the cams 18 and 20 rotate, the launch string 22 is unwound from the first and second launch string tracks 19 and 21. Simultaneously, the cables 44 and 46 wind into the first and second upper cable tracks 40 and 42 and the first and second lower cable tracks 41 and 43 of the first 18 and second 20 cams. When the launch string 22 has been drawn to the ready-to-fire position, it may be held in this the position by an operably releasable catch located in a housing 56. The first cable 44 is slide-able relative to the first cable pulley 215 and the second cable 46 is slide-able relative to the second cable pulley 216. The upper cable track 40, the lower cable track 41, the upper cable track 42 and the lower cable track 43 may be generally circular, or non-circular.

Figure 4A:
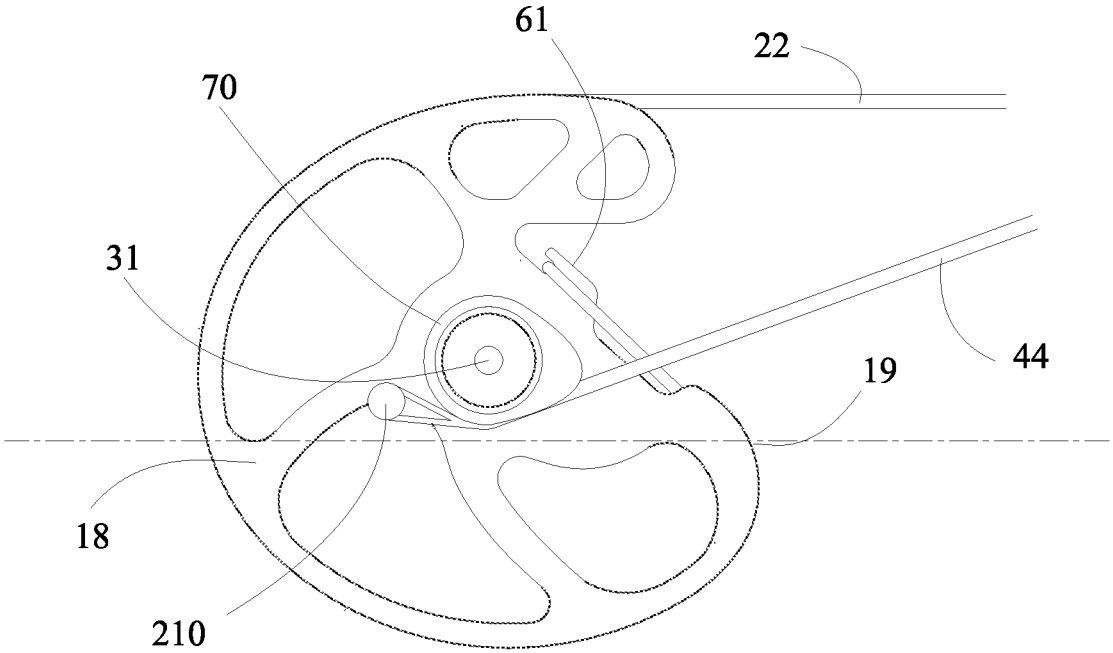
FIG. 4A is a top view of a first multi-piece cam with non-circular cable tracks of the present invention, a string and cable are illustrated with the cam of the present invention.
Figure 4B:
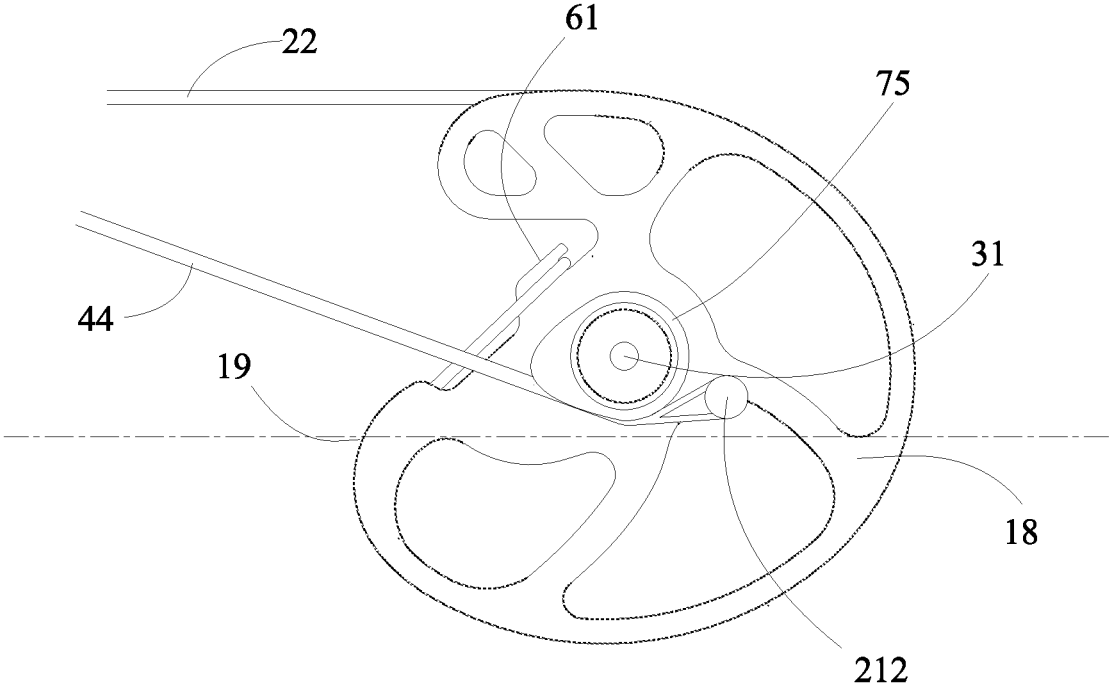
FIG. 4B is a bottom view of a first multi-piece cam with non-circular cable tracks of the present invention, a string and cable are illustrated with the cam of the present invention.
Figure 4E:
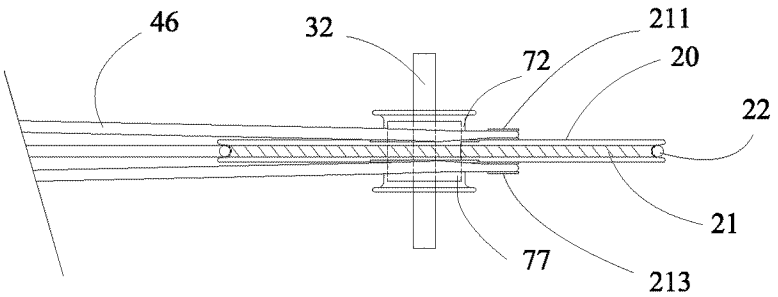
FIG. 4E is a side cut-away view of a second multi-piece cam with non-circular cable tracks of the present invention, having an upper and lower cable track, a string and cable are illustrated with the cam of the present invention.
Figure 4F:
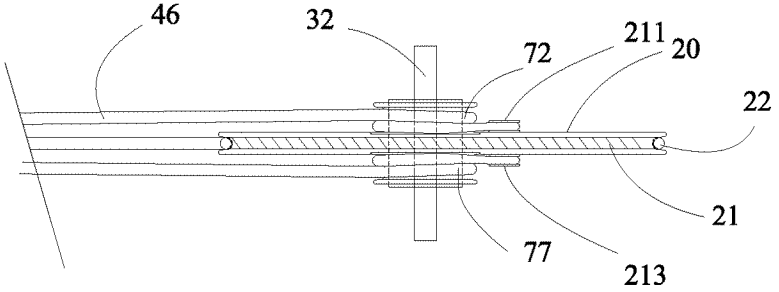
FIG. 4F is an exploded side view of a second multi-piece piece cam with non-circular cable tracks of the present invention having an upper and lower cable track, and having first and second mirror image modules of the present invention.
Figure 4C:
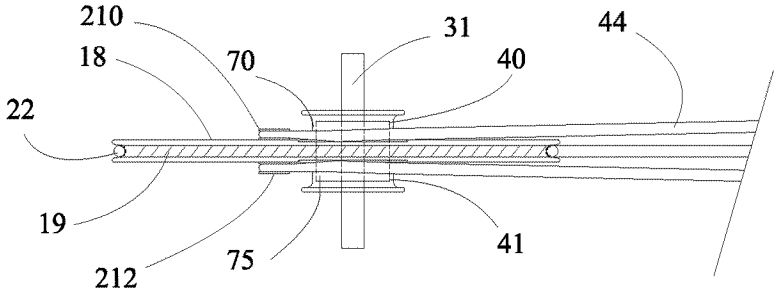
FIG. 4C is a side cut-away view of a first multi-piece cam with non-circular cable tracks of the present invention, having an upper and lower cable track, a string and cable are illustrated with the cam of the present invention.
Figure 4D:
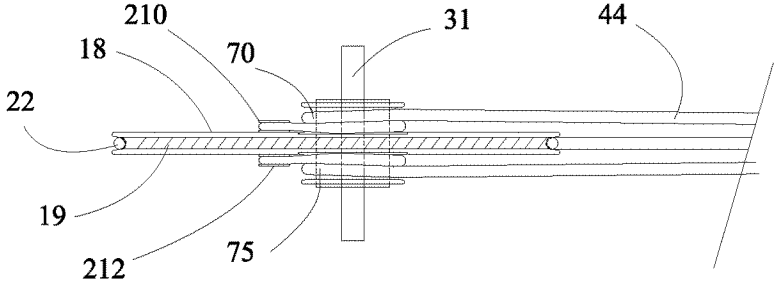
FIG. 4D is an exploded side view of a first multi-piece piece cam with non-circular cable tracks of the present invention having an upper and lower cable track, and having first and second mirror image modules of the present invention.
Figure 4I:
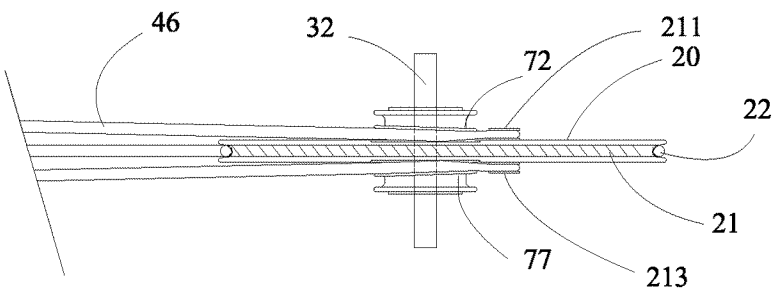
FIG. 4I is a side cut-away view of a second multi-piece cam with non-circular cable tracks of the present invention, having an upper and lower helical cable track, a string and cable are illustrated with the cam of the present invention.
Figure 4J:
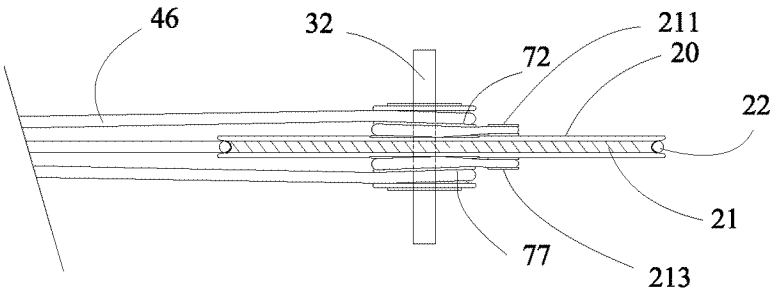
FIG. 4J is an exploded side view of a second multi-piece piece cam with non-circular cable tracks of the present invention having an upper and lower helical cable track, and having first and second mirror image modules of the present invention.
Figure 4G:
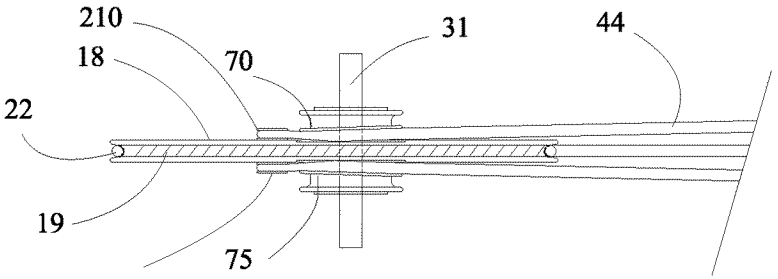
FIG. 4G is a side cut-away view of a first multi-piece cam with non-circular cable tracks of the present invention, having an upper and lower helical cable track, a string and cable are illustrated with the cam of the present invention.
Figure 4H:
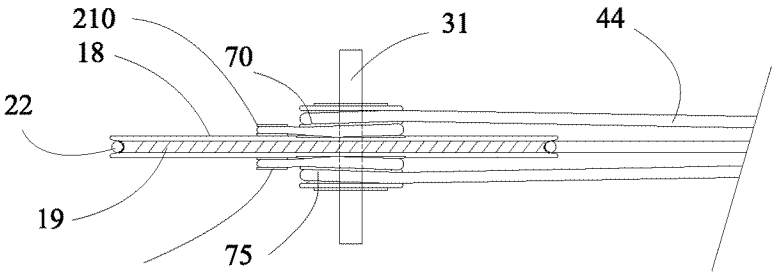
FIG. 4H is an exploded side view of a first multi-piece piece cam with non-circular cable tracks of the present invention having an upper and lower helical cable track, and having first and second mirror image modules of the present invention.

FIGS. 4A-4D and 5A—5D illustrate an embodiment of the first cam 18 of the current invention with string and cable(s), wherein the first cam 18 is constructed of a modular type construction. In this type of construction, the first and second side of the first cam 18 and the second cam 20 are mirror images of each other, and the first cam 18 is identical and interchangeable with the second cam 20. The first cam 18 includes a first module 70 and a second module 75. The first and second modules 70, 75 are mirror images of each other. The first and second modules 70, 75 are identical and are interchangeable with a first module 72 and a second module 77 of the second cam 20. Specifically, FIG. 4A is a top view of the first cam 18, FIG. 4B is a bottom view of the first cam 18, FIG. 4C is a cut-away view of the first cam 18 with the string 22 and the cable 44. The first module 70 and the second module 75 may be generally non-circular, or circular.

FIGS. 4G-4J illustrate an alternative embodiment of the first cam 18 of the current invention with string and cable(s), wherein the first cam 18 is constructed of a modular type construction. In this type of construction, the first and second side of the first cam 18 and the second cam 20 are mirror images of each other, and the first cam 18 is identical and interchangeable with the second cam 20. The first cam 18 includes a first helical module 70 and a second helical module 75. The first and second helical modules 70, 75 are mirror images of each other. The first and second helical modules 70, 75 are identical and are interchangeable with a first module 72 and a second module 77 of the second cam 20.

Figure 5A:
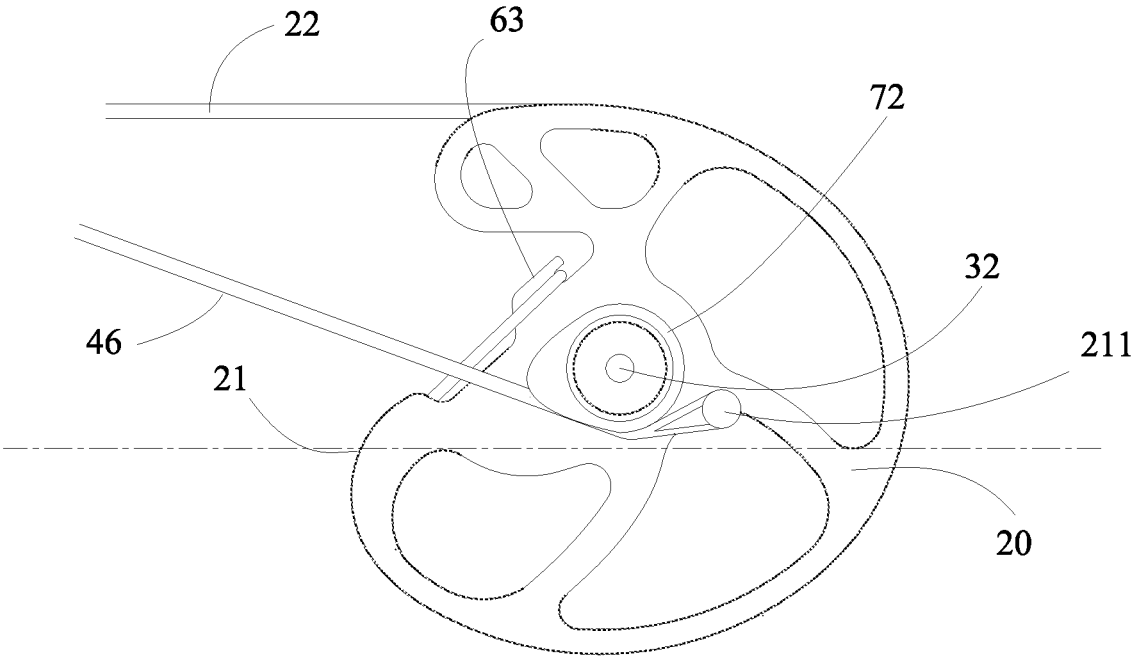
FIG. 5A is a top view of a second multi-piece cam with non-circular cable tracks of the present invention, a string and cable are illustrated with the cam of the present invention.
Figure 5B:
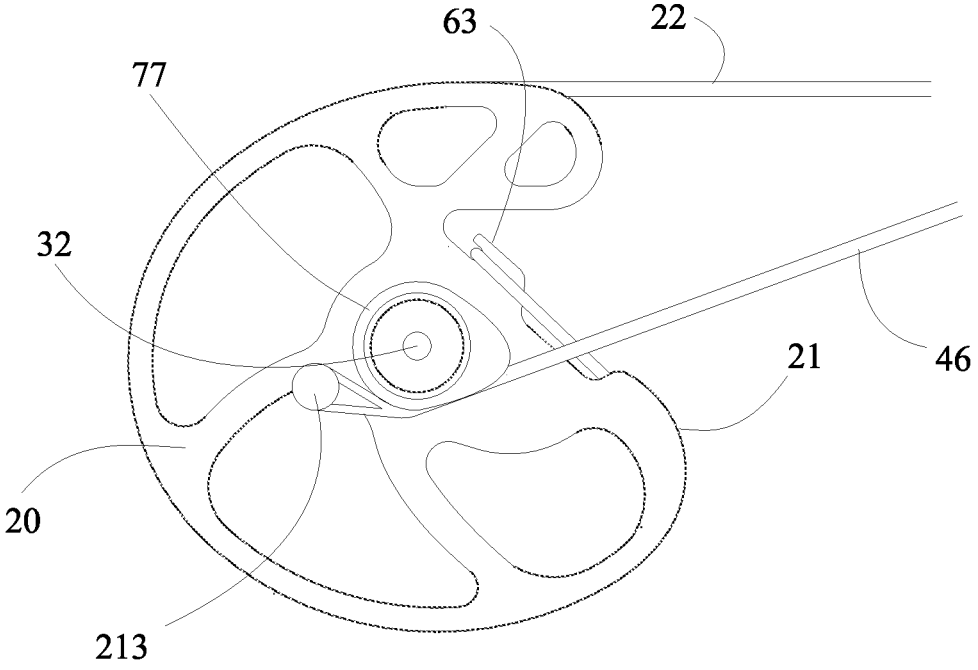
FIG. 5B is a bottom view of a second multi-piece cam with non-circular cable tracks of the present invention, a string and cable are illustrated with the cam of the present invention.
Figure 5C:
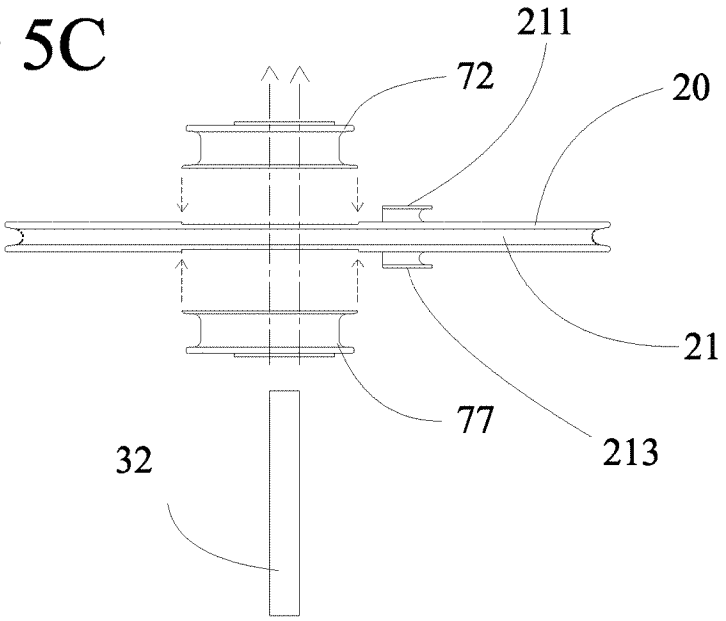
FIG. 5C is an exploded side view of a second multi-piece piece cam with non-circular cable tracks of the present invention having an upper and lower cable track that, and having a first and second mirror image modules of the present invention.
Figure 5D:
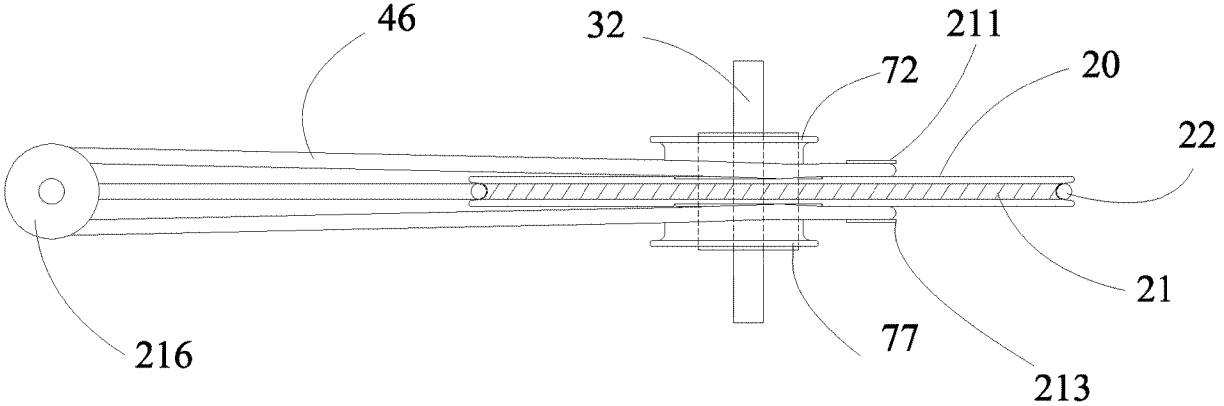
FIG. 5D is a side cut-away view of a second multi-piece cam with non-circular cable tracks of the present invention, having an upper and lower cable track; opposing ends of the second cable are anchored to the second cam, and a mid-segment of said second cable partially wraps a second cable pulley, a string and second cable are illustrated with the cam of the present invention.
Figure 5E:
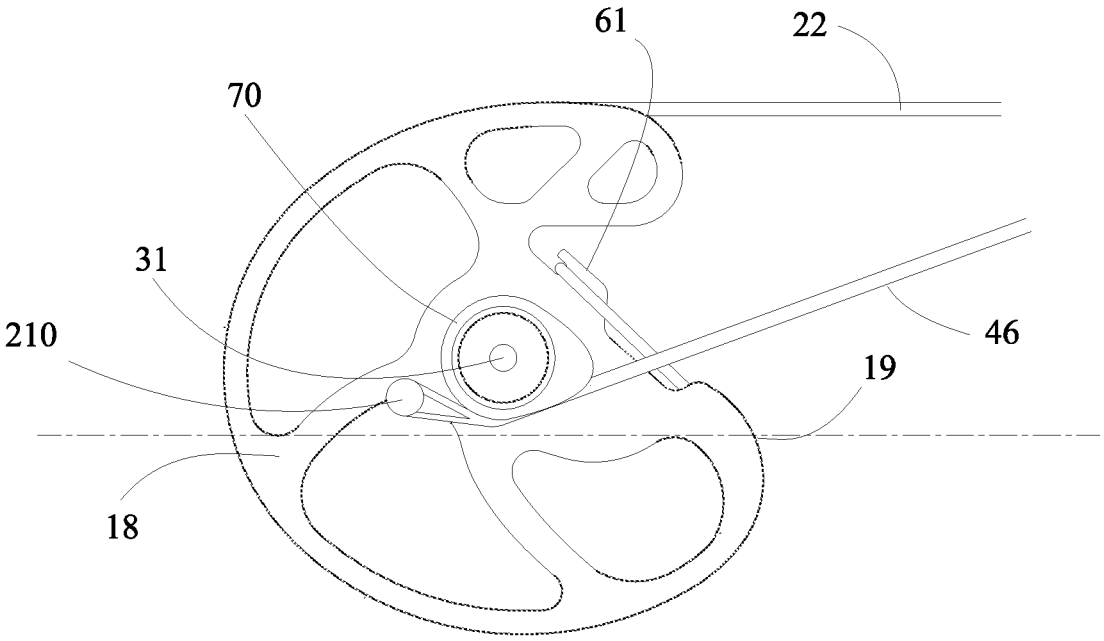
FIG. 5E is a top view of a first multi-piece cam with non-circular cable tracks of the present invention, a string and cable are illustrated with the cam of the present invention.
Figure 5F:
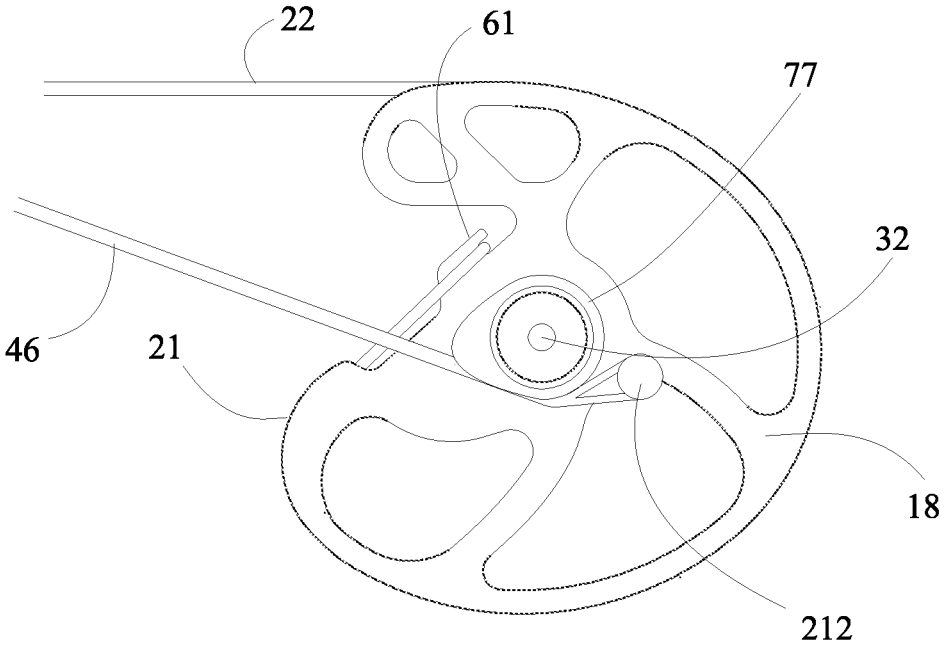
FIG. 5F is a bottom view of a first multi-piece cam with non-circular cable tracks of the present invention, a string and cable are illustrated with the cam of the present invention.
Figure 5G:
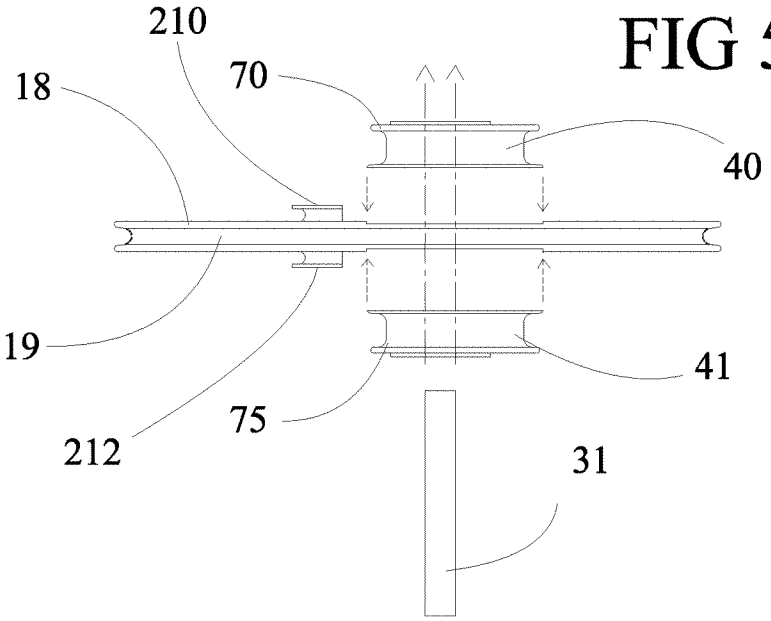
FIG. 5G is an exploded side view of a first multi-piece piece cam with non-circular cable tracks of the present invention having an upper and lower cable track, and having a first and second mirror image modules of the present invention.
Figure 5H:
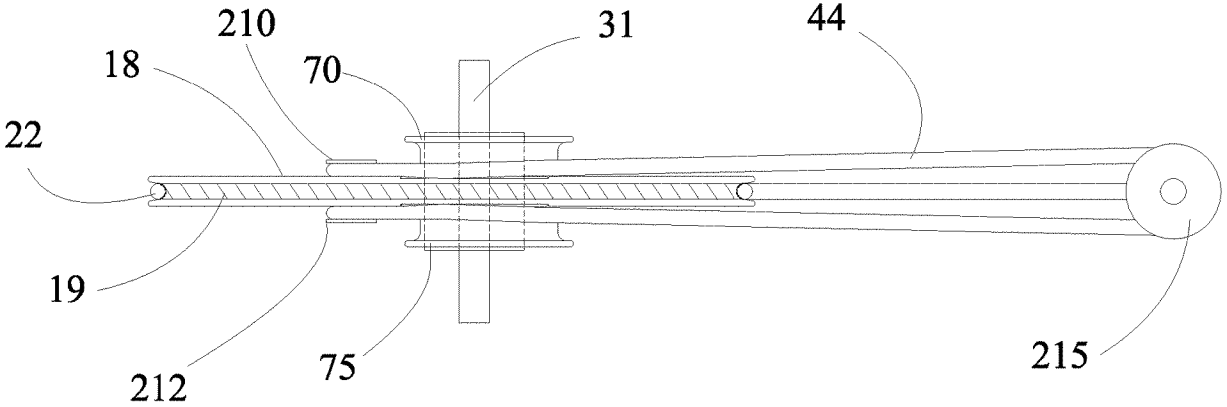
FIG. 5H is a side cut-away view of a first multi-piece cam with non-circular cable tracks of the present invention, having an upper and lower cable track; opposing ends of the first cable are anchored to the first cam, and a mid-segment of said first cable partially wraps a first cable pulley, a string and first cable are illustrated with the cam of the present invention.

FIGS. 5A-5D illustrate an embodiment of the second cam 20 of the current invention, with string and cable(s), wherein the second cam 20 is constructed of a modular type construction. In this type of construction, the first and second side of the second cam 20 and the first cam 18 are mirror images of each other, and the first cam 18 is identical and interchangeable with the second cam 20. The first module 72 and the second module 77 are mirror images of each other, and the first and second modules 70 and 75 are identical and interchangeable with the first and second modules 72 and 77. Specifically, FIG. 5A is a top view of the second cam 20, FIG. 5B is a bottom view of the second cam 20, FIG. 5C is a cut-away view of a second cam with the string 22 and the cable 46. The first module 72 and the second cable module 77 may be generally non-circular, or circular. FIG. 6A illustrates a top view of the first cam 18 and the second cam 20, in the drawn position. FIG. 6B illustrates a bottom view of the first cam 18 and the second cam 20, in the drawn position. FIGS. 6A and 6B are identical to each other and not just mirror images, as described previously in FIGS. 5A-5D. This feature allows for an easier method of manufacture and assembly.

A first end of the launch string 22 is anchored to the first cam string post 61; a segment of the launch string 22 partially wraps cam 18 in the string track 19; the string crosses the center of the riser 10; and partially wraps the second cam 20 in the string track 21; and the second end of the launch string 22 is anchored to the second cam string post 63.

With reference to FIGS. 4A-4D and 5A—5D, the mid-segment of the first and second cables 44, 46 "slidably" engage the first and second cable pulleys 215 and 216, which allows the first and second cables 44, 46 to self-center themselves relative to a first side and a second side of the first and second cams 18 and 20. The self-centering feature of the cables 44, 46 provides for automatic cable timing, which eliminates cam lean, and timing issues. As the launch string 22 is drawn, the launch string unwraps, or "pays out" from the first and second cams 18, 20. Simultaneously, the first and second cables 44, 46 wrap the respective first cable tracks 70, 75 and the second cable tracks 72, 77.

It is preferable that the second ends of the first and second cables 44 and 46 not be anchored to the same post.

However the first and second cables 44, 46 will still function satisfactorily if anchored to the same post.

With reference to FIGS. 7, 7A, 7B, and 7C, the first cable 44 is coupled with the first cam 18. A first end 44*a* is anchored to the first cam 18, a first segment 44*b* is engaged with a first cable track 40, a mid-segment 44*c* is engaged with a first pulley 217, a second segment (not shown) is engaged with a second cable track (not shown), and a second cable end (not shown) is anchored to the first cam 18.

The second cable 46 is coupled with the second cam 20. A first end 46*a* is anchored to the second cam 20, a first segment 46*b* is engaged with a first cable track 40, a mid-segment 46*c* is engaged with a first pulley 217, a second segment (not shown) is engaged with a second cable track (not shown), and a second cable end (not shown) is anchored to the second cam 20.

Figure 7:
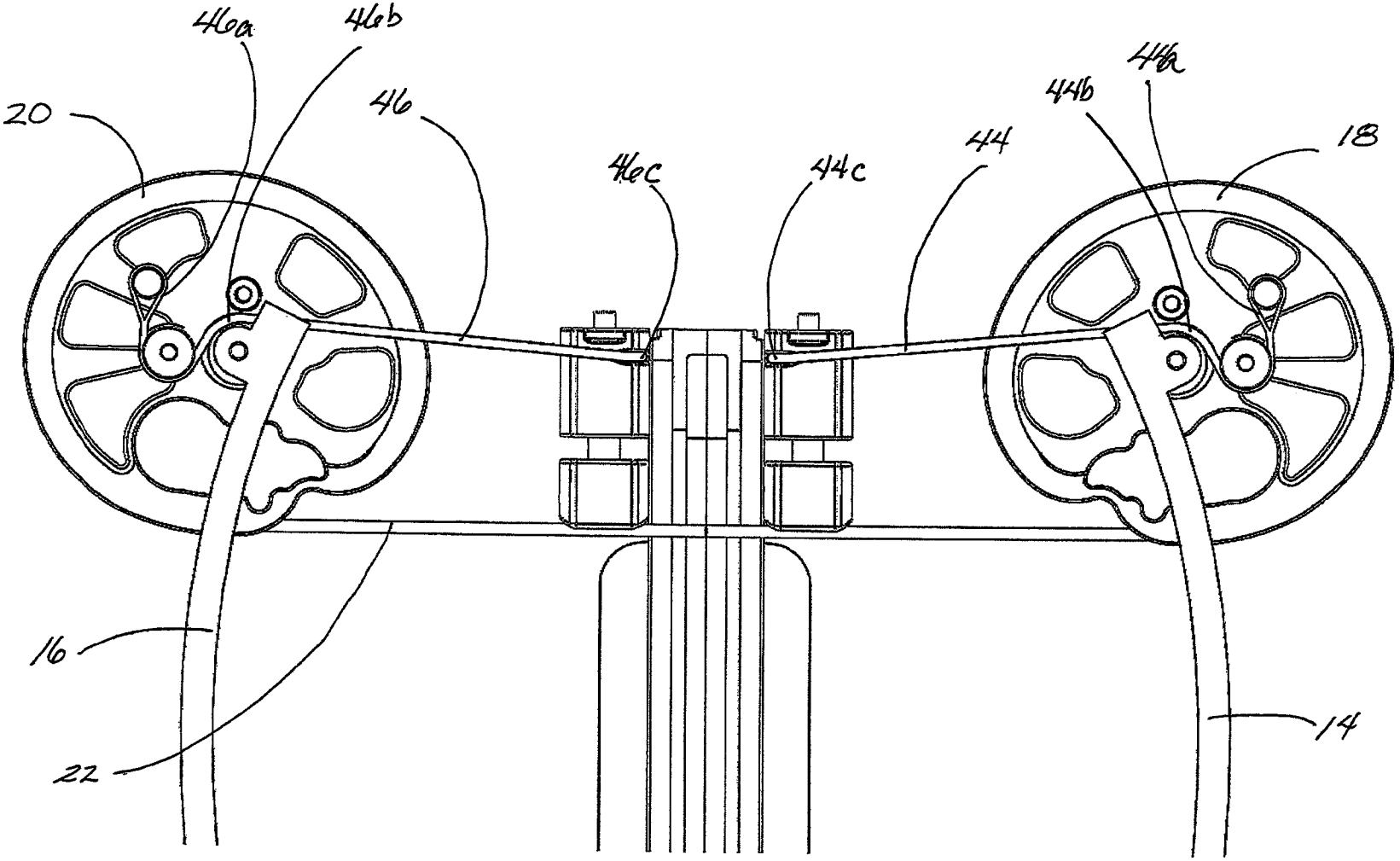
FIG. 7 is a partial top view having a first cable coupled with a first cam and a second cable coupled with a second cam, wherein the cable ends are anchored on the cams and the bow is uncocked of the present invention
Figure 7A:
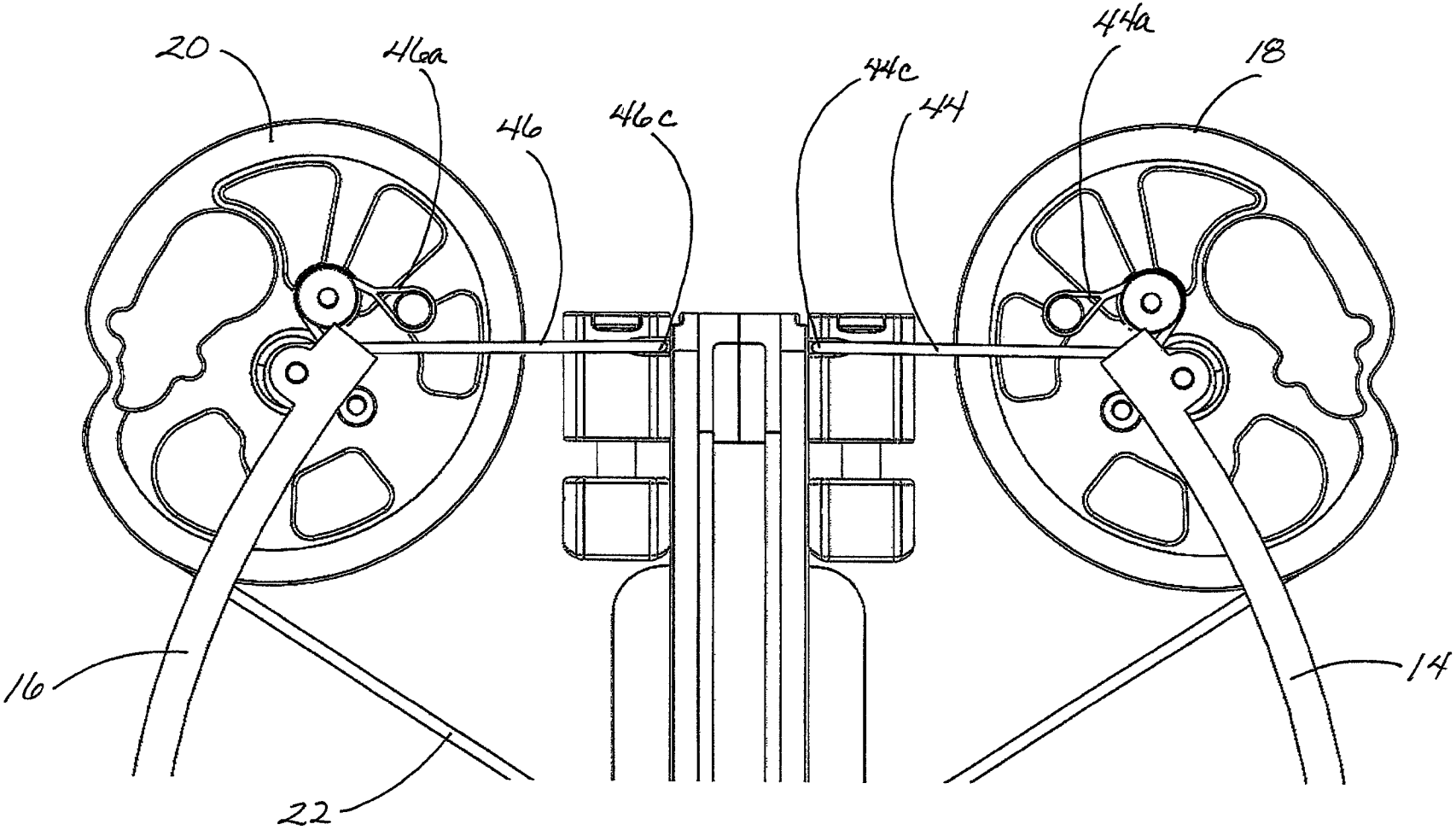
FIG. 7A is a partial top view having a first cable coupled with a first cam and a second cable coupled with a second cam, wherein the cable ends are anchored on the cams and the bow is cocked of the present invention
Figure 7B:
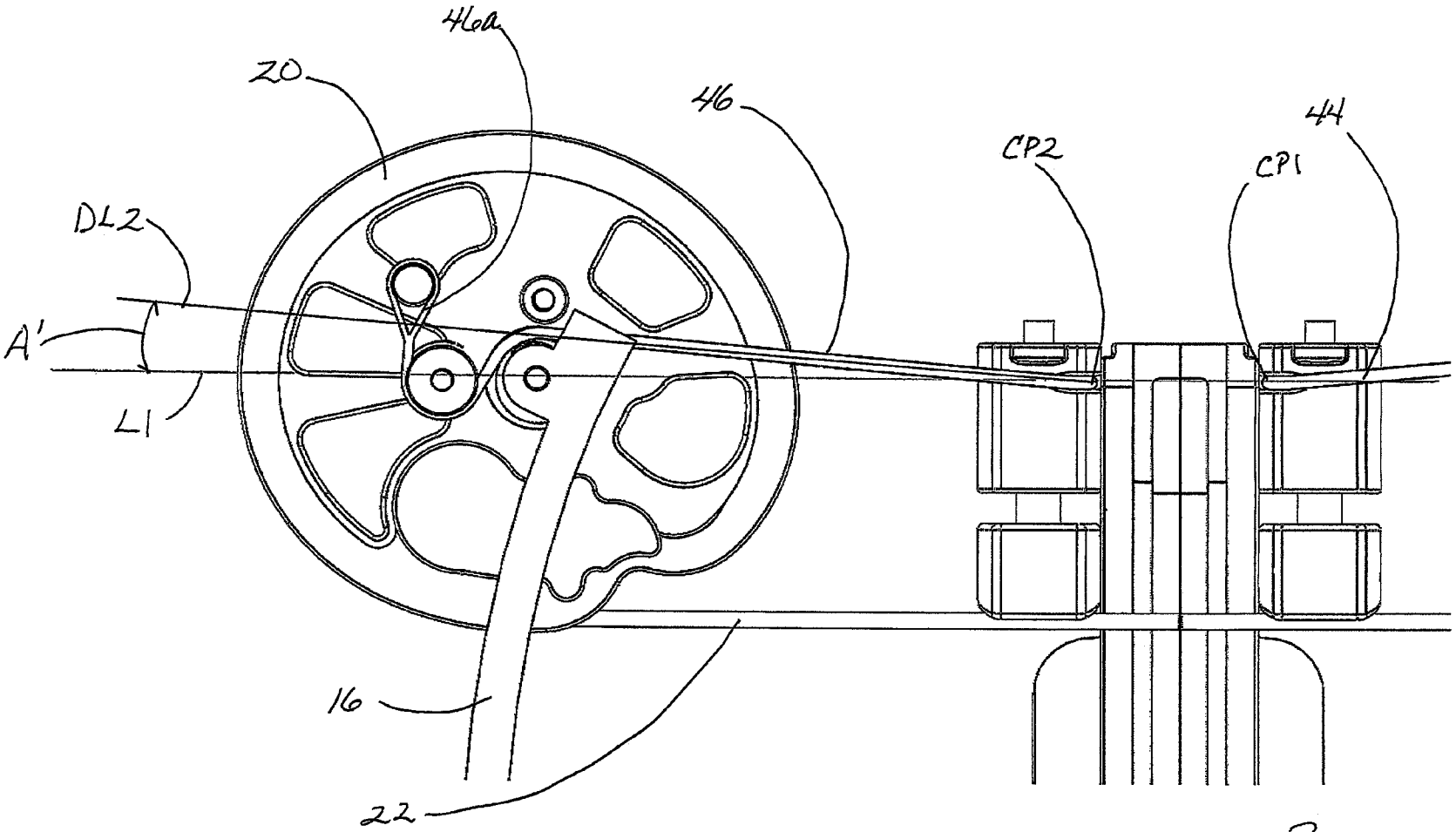
FIG. 7B is a partial top view having a first cable coupled with a first cam and a second cable coupled with a second cam, wherein the cable ends are anchored on the cams and the bow is uncocked of the present invention

Referring specifically to FIG. 7B, mid segments 44*b* and 46*b* transition the first cable 44 and second cable 46 from a first side of cams 18 and 20 to the second side of cams 18 and 20. A line L1 is drawn between the location of the center point of the first cable CP1 and the location of the center point of the second cable CP2. Line L1 is parallel with the bowstring 22 when the bow is uncocked. A departure line DL2 is drawn from CP2 to the center of the cable at the departure point DP2 wherein the first segment 46*b* of the second cable 46 disengages from the first cable track 40 of the second cam 20. The angle A' between lines L1 and DL2 when the bow is uncocked is measured in degrees. It is preferred that this angle is less than about thirty degrees, and most preferably zero degrees.

A line L1 is drawn between the location of the center point of the first cable CP1 and the location of the center point of the second cable CP2. Line L1 is parallel with the bowstring 22 when the bow is uncocked. A departure line DL2 is drawn from CP2 to the departure point DP2 wherein the first segment 46*b* of the second cable 46 disengages from the first cable track 40 of the second cam 20. The angle A' between lines L1 and DL2 when the bow is uncocked is measured in degrees. It is preferred that this angle is less than about thirty degrees, and most preferably zero degrees.

Figure 7C:
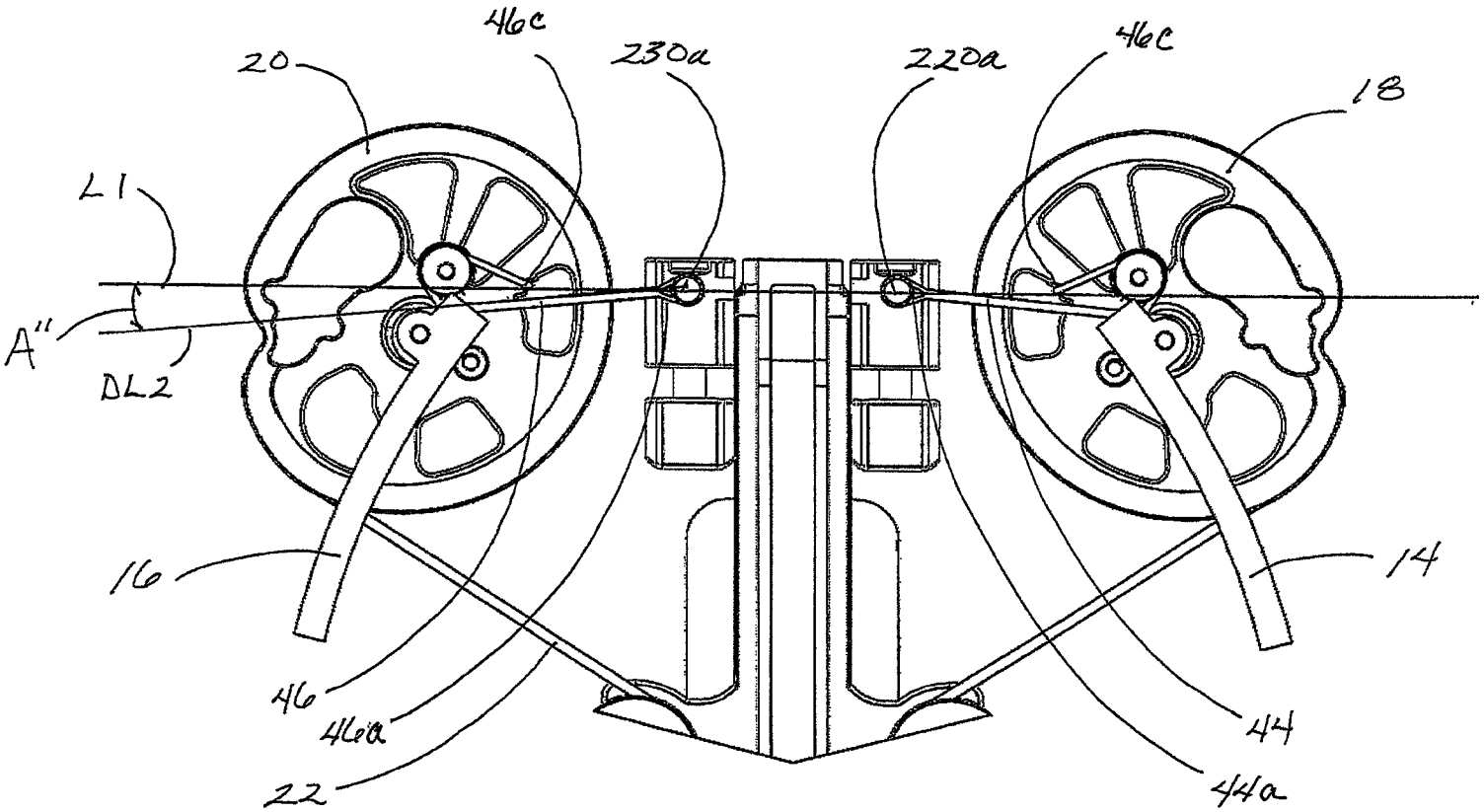
FIG. 7C is a partial top view having a first cable coupled with a first cam and a second cable coupled with a second cam, wherein the cable ends are anchored adjacent the cams and the bow is cocked of the present invention

Referring specifically to FIG. 7C, an alternative embodiment is shown with the bow in the cocked position. A first end 44*a* of the first cable 44 is anchored to a first cable post 220*a* adjacent the first cam 18. A first segment 44*b* engages a first cable track 40, a mid-segment 44*c* transitions the first cable 44 from a first side of cam 18 to the second side of cam 18 by passing through an opening portal in the cam, a second segment (not shown) engages a second cable track (not shown) of the first cam 18, and the second end (not shown) of the first cable 44 is anchor to a second cable post (not shown) adjacent the first cam 18.

A first end 46*a* of the second cable 46 is anchored to a third cable post 220*a* adjacent the second cam 20. A first segment 46*b* engages a first cable track 40 of the second cam 20, a mid-segment 46*c* transitions the second cable 46 from a first side of cam 20 to the second side of cam 20 by passing through an opening portal in the cam 20, a second segment 46*d* engages a second cable track 41 of the second cam 20, and the second end 46*e* of the first cable 46 is anchored to a fourth cable post 230*b* adjacent the second cam 20.

A line L1 is drawn between the location of the center point of the first cable post 220*a* and the location of the center point of the third cable post 230*a*. Line L1 is parallel with the bowstring 22 when the bow is uncocked. A departure line DL2 is drawn from center point of the third cable post 230*a* to the departure point DP2 wherein the first segment 46*b* of the second cable 46 disengages from the first cable track 40 of the second cam 20. The angle A' between lines L1 and DL2 when the bow is uncocked is measured in degrees. It is preferred that this angle is less than about thirty degrees, and most preferably zero degrees. When the bow is cocked, it is preferred that the angle A" between lines L1 and DL2 is less than about thirty degrees.

It is preferred that when the bowstring is at rest, line L1 and a line drawn from DP1 to DP2 are in line with each other. This unique feature provides for the least amount of shock.

Referring again to FIGS. 7, 7A, and 7B the current disclosure, a reverse draw style crossbow having FFL and non-inverted cams having the bowstring unwind from the rear of the cams, and the cables are engaged with the cams forward the cam axles. There is only one cable per cam, each cable having a first end and a second end, a first adjacent segment and a second adjacent segment, a first span, a mid-segment, and a second span. Both ends of the first cable are anchored to the first cam, and both ends of the second cable are anchored to the second cam. When the crossbow is uncocked, the first and second cables' first span and second span partially engage the corresponding cable tracks on opposite sides of the string tracks, then disengage the cable tracks at a departure point (DP1 and DP2). The first cable first span and second span are parallel to each other on a vertical plane, and the second cable first span and second span are parallel to each other on a vertical plane, in that when the crossbow is viewed from directly above or directly below, only a single span is visible of each cable. The first cable first span and second span may or may not be parallel to each other on a horizontal plane, and the second cable first span and second span may or may not be parallel to each other on a horizontal plane, in that when the crossbow is viewed from the front or rear, the spans may or may not be parallel to each other.

The mid-segment of the first cable engages a first cable pulley, and the mid segment of the second cable engages a second cable pulley. The first adjacent segment engages a first cable track on a first side of the first cam and a second adjacent segment engages at the second cable track on a second side of the cam.

A line L1 is drawn centered on the center of the first cable where the first cable is retained by the first cable pulley (CP1) and the center of the second cable where the second cable is retained by the second cable pulley (CP2), and extends outwardly in both directions. In an alternate embodiment, RP1 (Retainment Point) and RP2 also indicate the retainment position of the ends of the cables adjacent the cams.

In a first preferred embodiment, when the crossbow is in an uncocked position, a line drawn between DP1 and DP2 is in line with L1, and when the crossbow is in the cocked position, the angle A" between L1 and the first and second segments of the first cable and the first and second segments of the second cable as measured from DP1 to CP1 and from DP2 to CP2 are no more than about minus thirty degrees.

In a second preferred embodiment, when the crossbow is in an uncocked position, a line drawn between DP1 and DP2 is in line with L1, and when the crossbow is in the cocked position, the angle A" between L1 and the first and second segments of the first cable and the first and second segments of the second cable as measured from DP1 to CP1 and from DP2 to CP2 are no more than about minus thirty degrees.

In a third preferred embodiment, when the crossbow is in an uncocked position, the angle A' between L1 and the first and second segments of the first cable and the first and second segments of the second cable as measured from DP1 to CP1 and from DP2 to CP2 are no more than about fifteen degrees. When the crossbow is in more or less the half-cocked position, L1 and the first and second segments of the first cable and the first and second segments of the second cable are in line with each other, and when the crossbow is in the cocked position, the angle A" between L1 and the first and second segments of the first cable and the first and second segments of the second cable as measured from DP1 to CP1 and from DP2 to CP2 are no more than about minus fifteen degrees.

An alternative embodiment is similar the preferred embodiment, with the exception that the cable spans do not have to be in line with L1 when the bow is cocked or half-cocked, however the angle variation between cocked as measured from DP1 to CP1 and from DP2 to CP2 are no more than about thirty degrees. Further, the cable ends may not be anchored to the cams, in that the ends are anchored relative to the frame, and the mid-section of the cables passes through the cam body.

Figure 8:
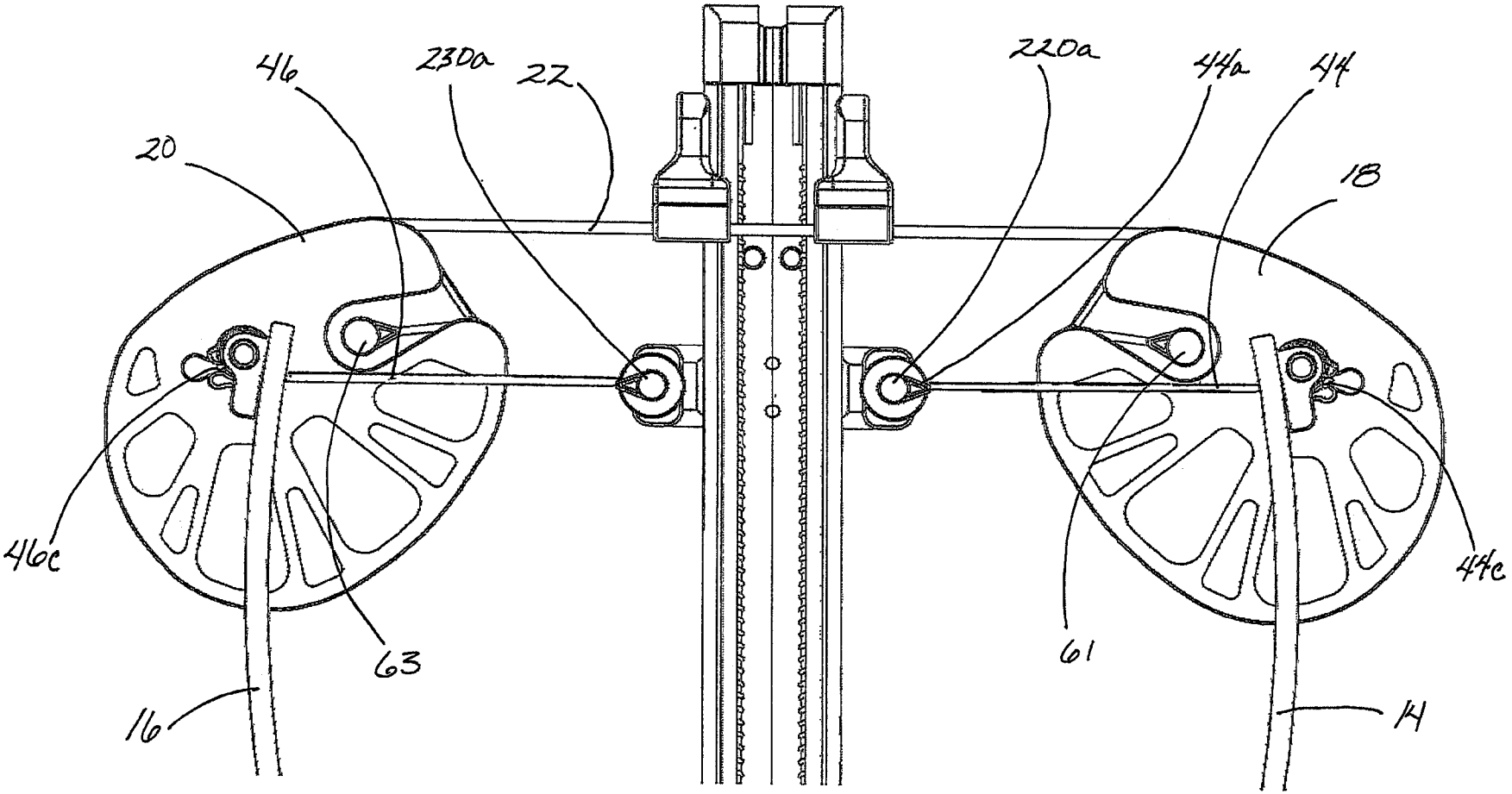
FIG. 8 is a partial top view of an uncocked projectile launching device having forward facing limbs, a single cable per cam, cable ends anchored adjacent the cams, and the mid-segment of the cables passing through a portal of the cams of the present invention.
Figure 8A:
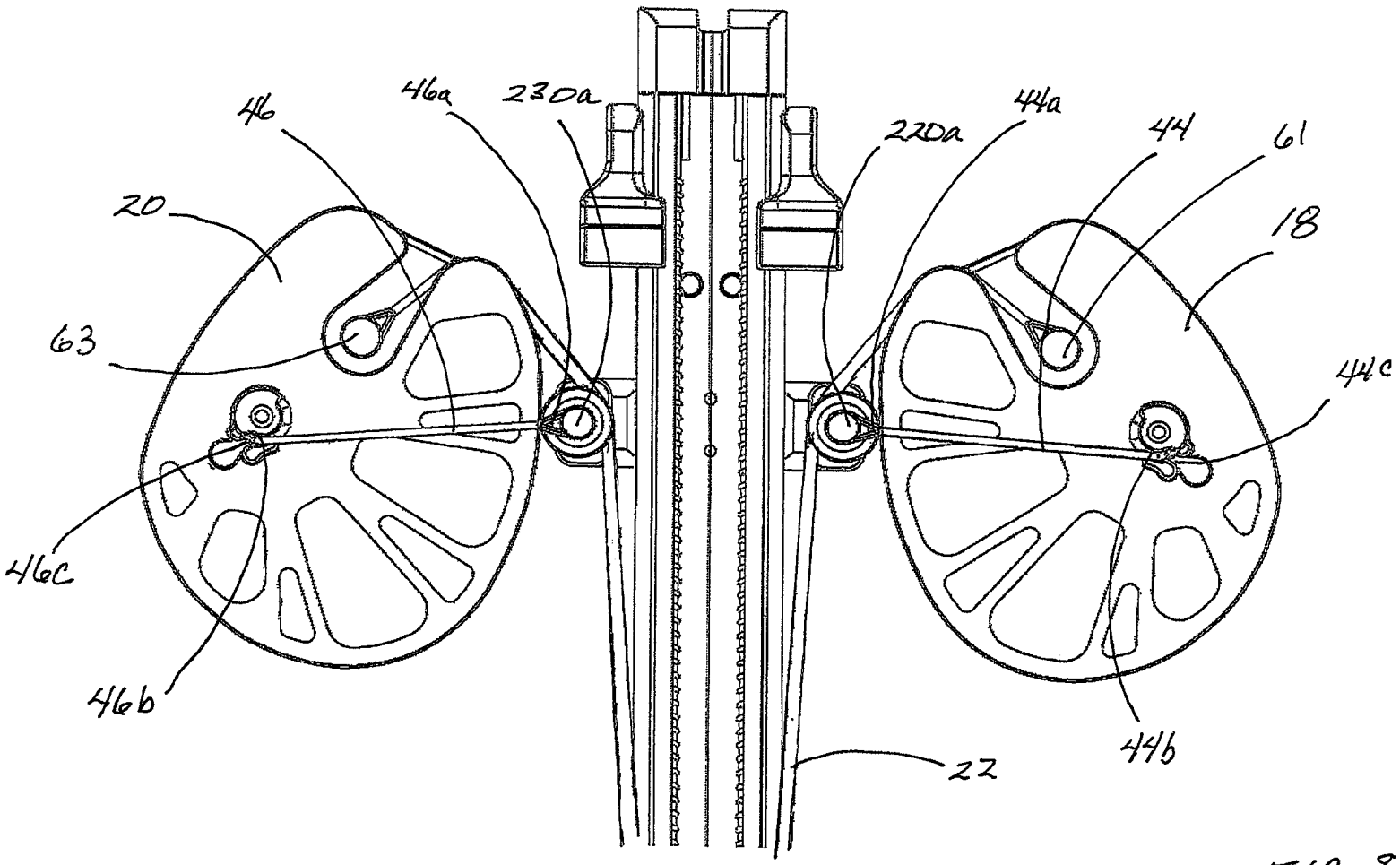
FIG. 8*a* is a partial top view of a cocked projectile launching device having forward facing limbs, a single cable per cam, cable ends anchored adjacent the cams, and the mid-segment of the cables passing through a portal of the cams of the present invention.
Figure 8B:
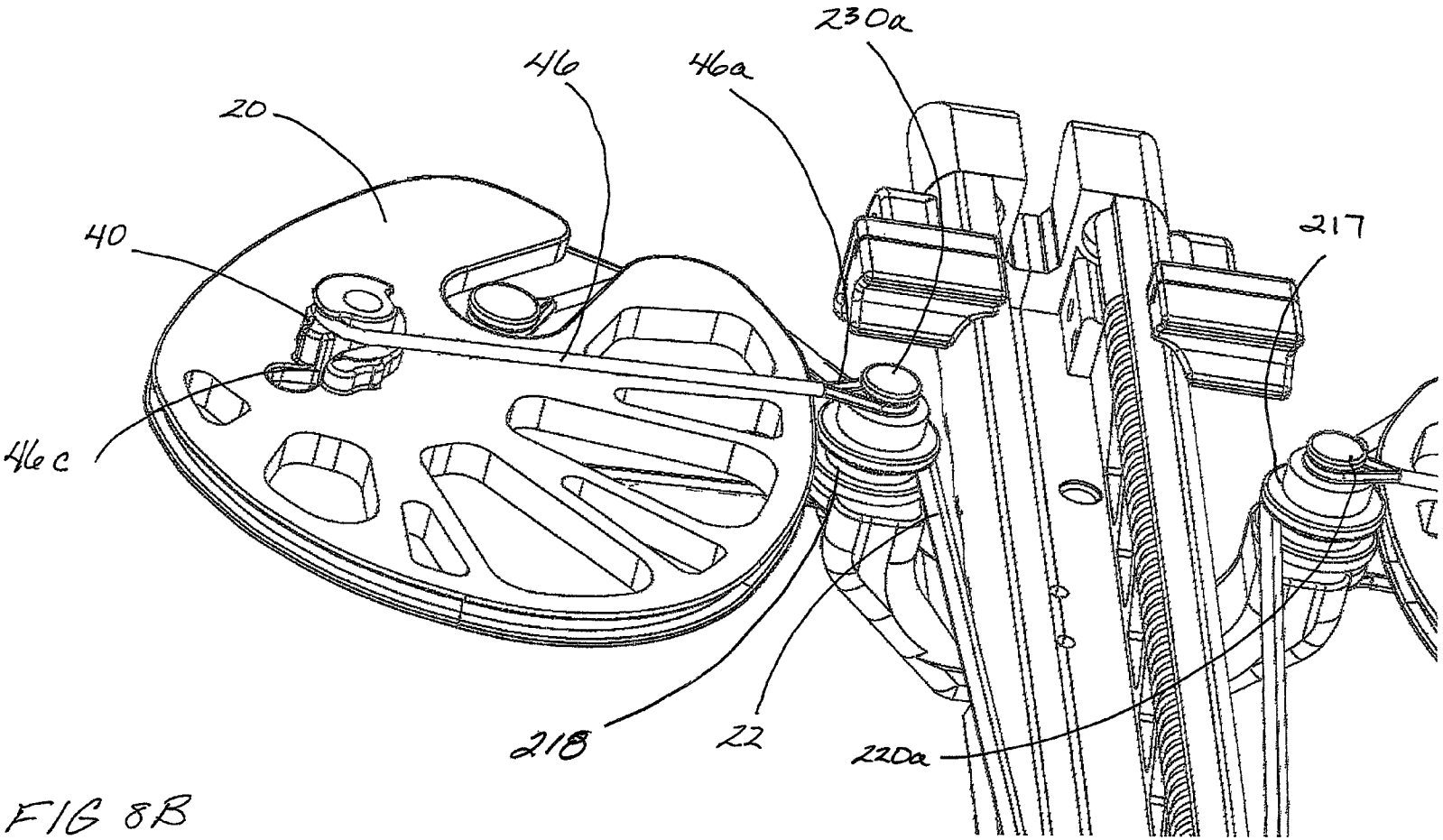
FIG. 8*b* is a partial perspective view of a cocked projectile launching device having forward facing limbs, a single cable per cam, cable ends anchored adjacent the cams, and the mid-segment of the cables passing through a portal of the cams of the present invention.
Figure 8C:
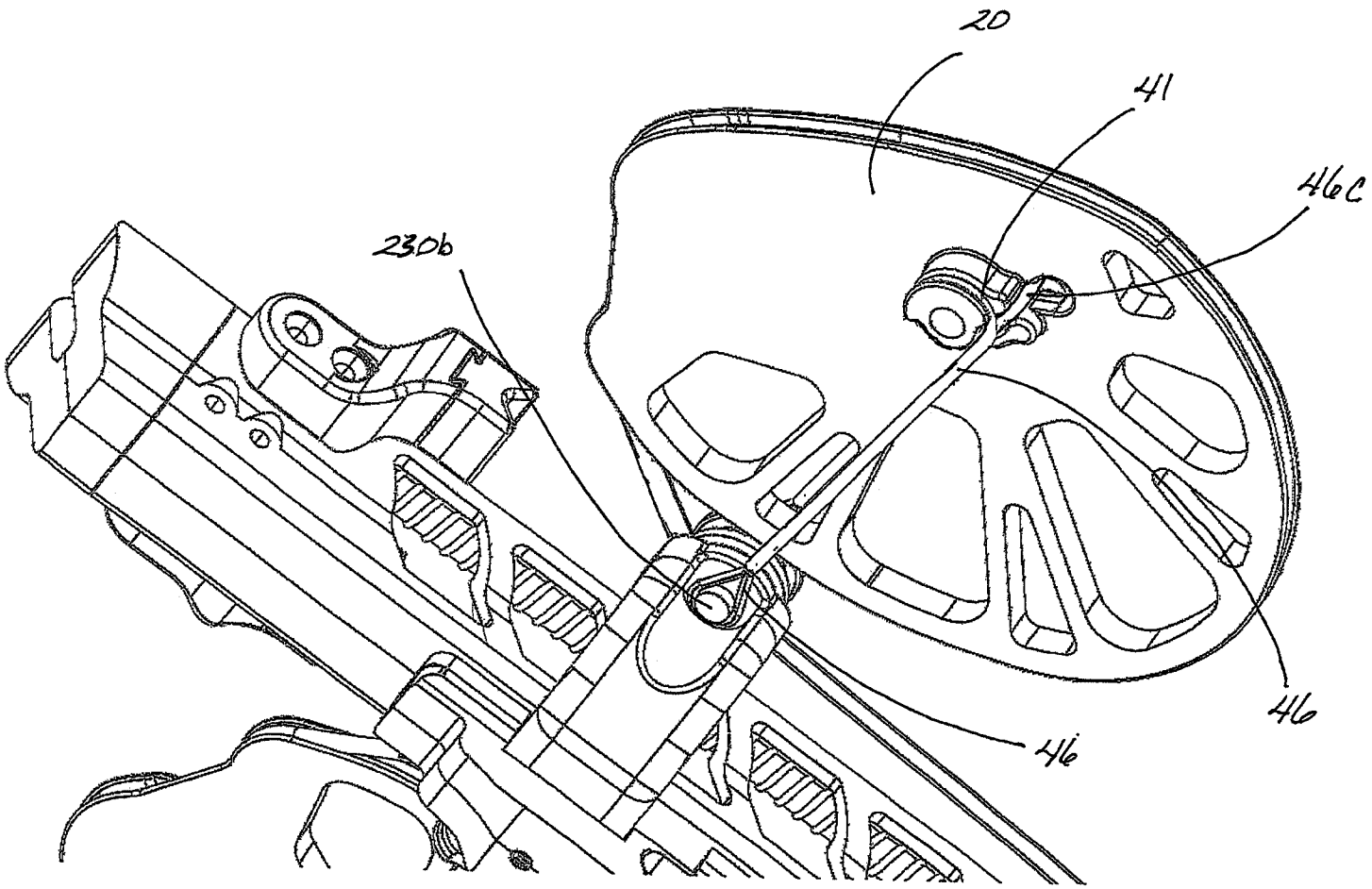
FIG. 8*c* is a partial perspective view of a cocked projectile launching device having forward facing limbs, a single cable per cam, cable ends anchored adjacent the cams, and the mid-segment of the cables passing through a portal of the cams of the present invention.
Figure 8D:
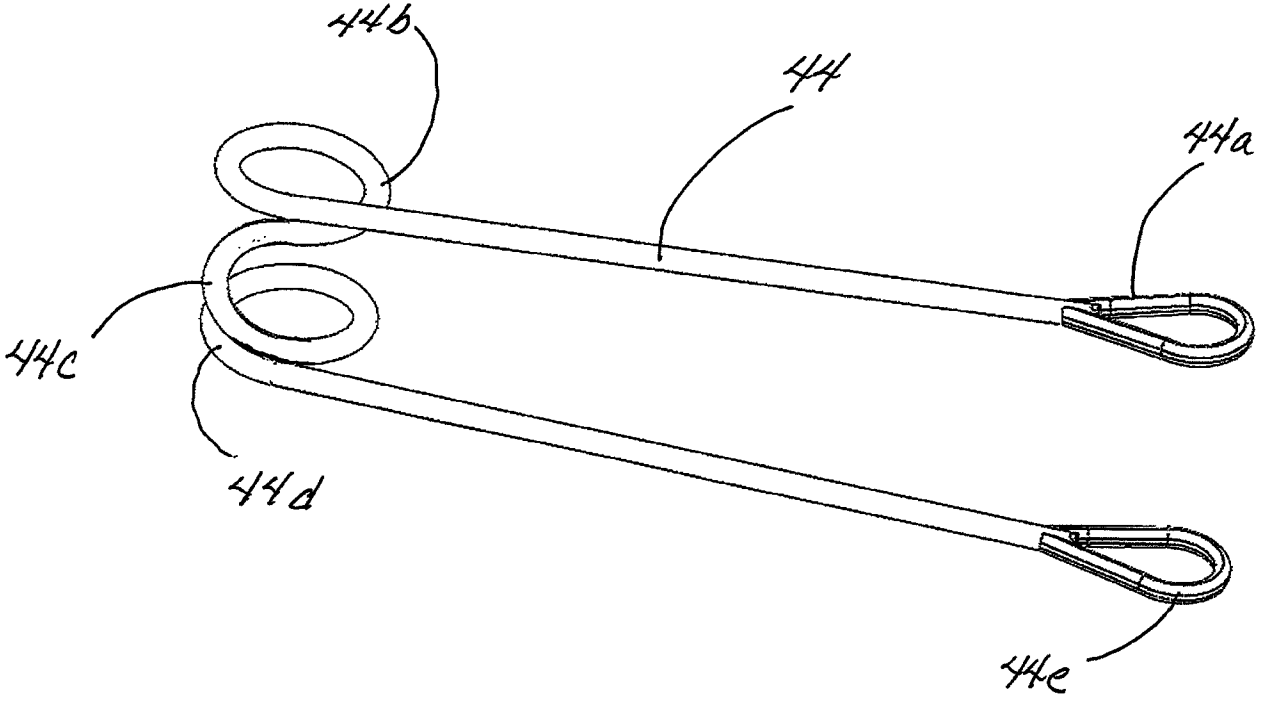
FIG. 8*d* is a perspective view of a projectile launching device, a single cable per cam, showing the cable path only when the device was in the cocked position, of the present invention.

Now referring to FIGS. 8, 8A, 8B, and 8C, disclosed is a reverse draw style crossbow having forward facing limbs (FFL) 14 and 16 wherein the bowstring 22 is drawn from the cams 18 and 20, forward the cam axles 31 and 32. First and second pulleys 217 and 218 support the bowstring 22 when the projectile launching device is drawn, which is best illustrated in FIG. 8B. The location of the pulleys 217 and 218 may or may not be axial with the cable posts 220*a*, 220*b*, 230*a* and 230*b*; the pulleys 217 and 218 may be forward or rearward the location of the cable posts 220*a*, 220*b*, 230*a*, and 230*b*.

Figure 9:
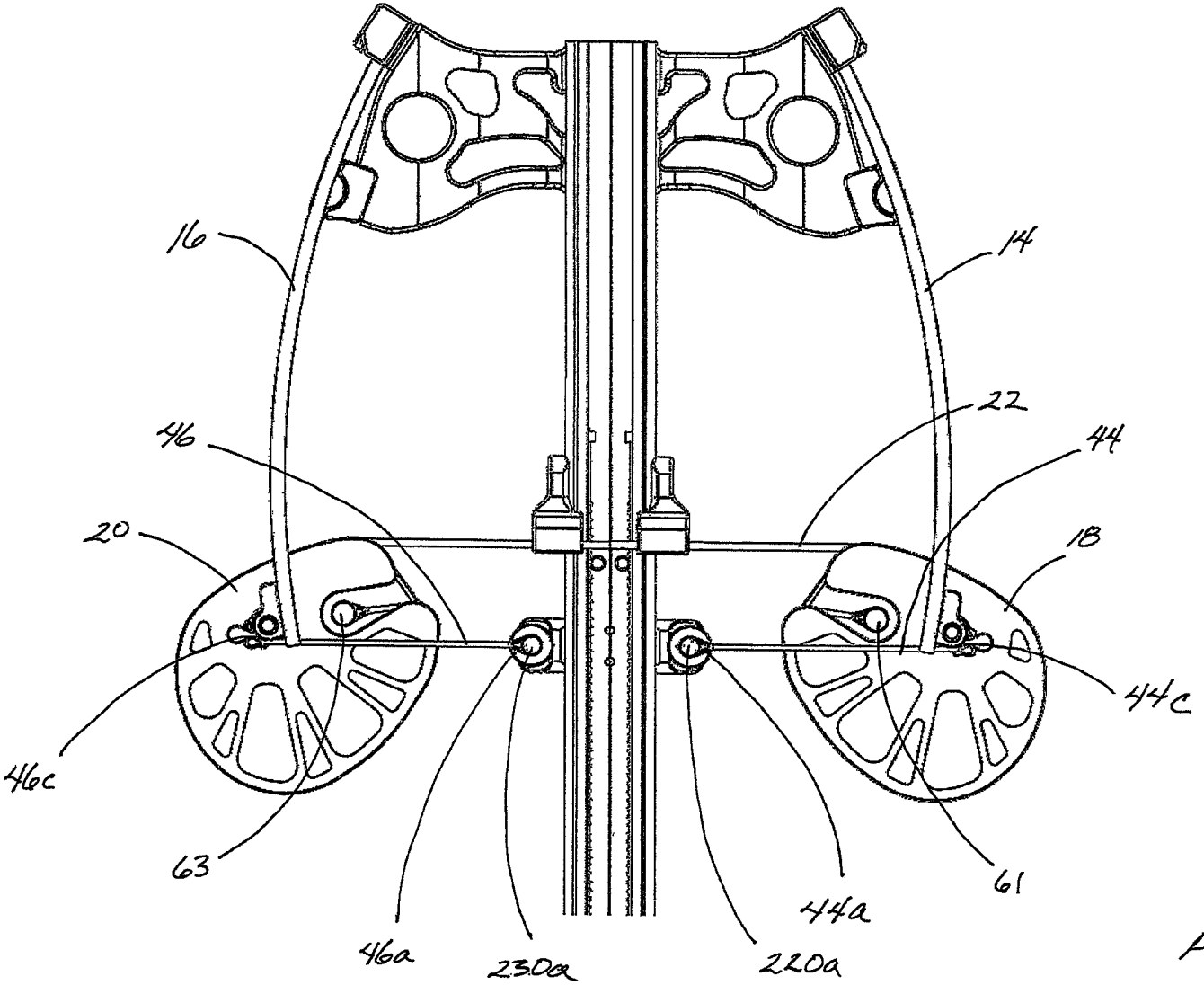
FIG. 9 is a partial top view of an uncocked projectile launching device having rear facing limbs, a single cable per cam, cable ends anchored adjacent the cams, and the mid-segment of the cables passing through a portal of the cams of the present invention.

Referring to FIG. 9, shown is an RFL type crossbow where the bowstring 22 has the main span, the portion of the bowstring 22 that spans between the first cam 18 and the second cam 20, forward cam journaling device. The bowstring pulleys 217 and 218 are supported between the upper cable anchors 220*a* and 230*a* and lower cable anchors 220*b* and 230*b*. The bowstring 22 begins the draw cycle not in contact with the bowstring support pulleys 217 and 218. The bowstring 22 contacts the bowstring supports pulleys 217 and 218 within a few inches of the at-rest position of the bowstring 22, and stays in contact with the support pulleys 217 and 218 the remainder of the draw cycle, and when the crossbow is cocked.

Figure 9A:
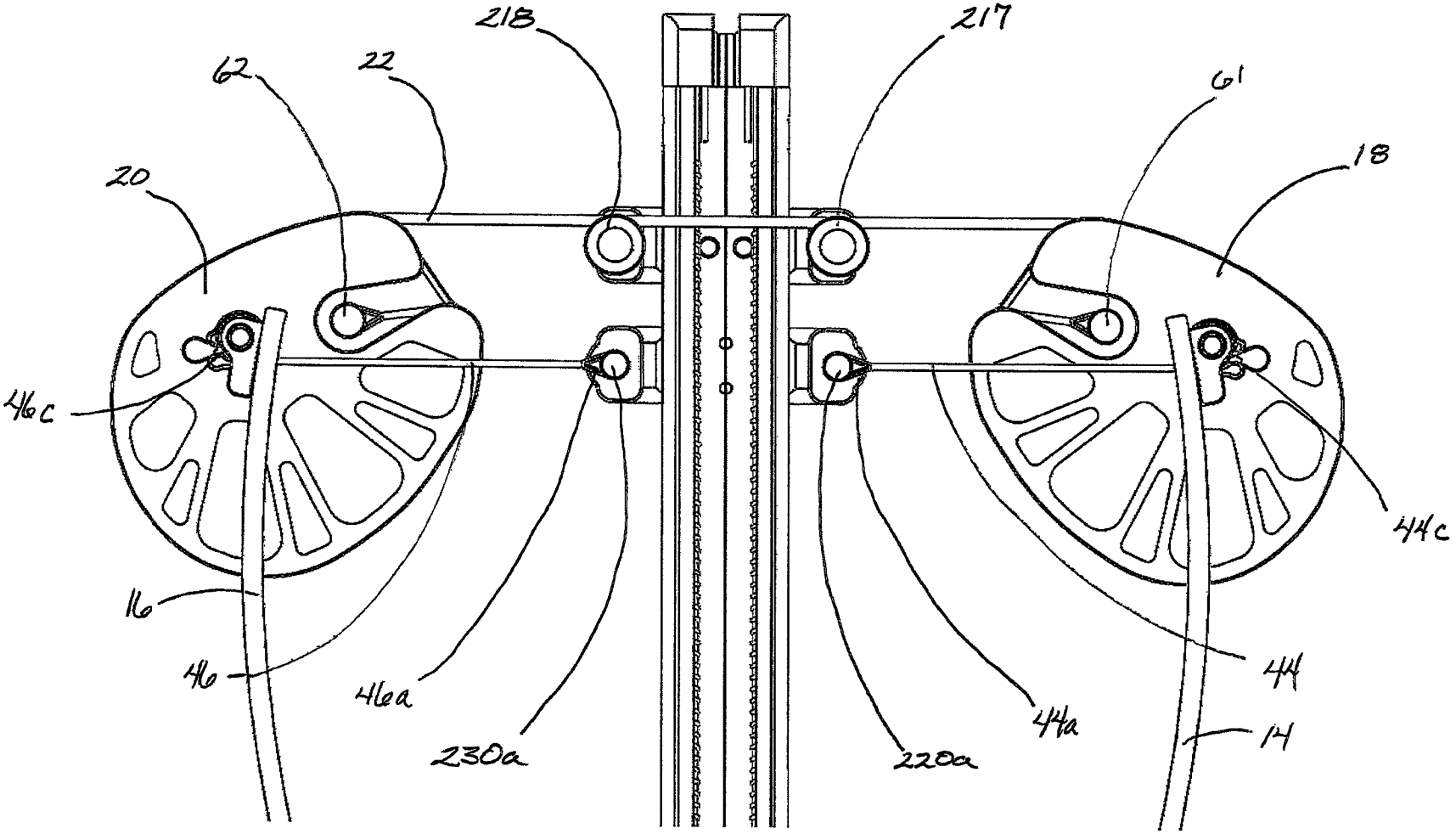
FIG. 9*a* is a partial top view of an uncocked projectile launching device having forward facing limbs, a single cable per cam, cable ends anchored adjacent the cams, the mid-segment of the cables passing through a portal of the cams, and pulleys supporting the bowstring forward the cables of the present invention.

Referring to FIG. 9A, shown is an FFL type crossbow where the bowstring 22 main span is forward the cam journaling device, The bowstring support pulleys 217 and 218 are engaged with the bowstring 22 when the bowstring 22 is at rest. The bowstring 22 stays in contact with the bowstring support pulleys 217 and 218 the entire draw cycle, and when the crossbow is cocked.

A cable arrangement of the current disclosure allows for self-timing, no cam lean, minimal parasitic loss of energy, and minimal shock and vibration due to the low angle of cable movement from when the crossbow is cocked to when the crossbow is fired.

While the preferred embodiments of the invention have been illustrated and described, it will be obvious to those skilled in the art that changes and modifications may be made without departing from the invention in its broader aspects, and therefore, the aim in the appended claims is to cover all such changes and modifications as fall within the true spirit and scope of the invention. These modifications may change the location of the pulleys that support the bowstring and an example of such modification: FFL where the bowstring at rest, without the support pulleys, would place the bowstring span behind the cam axles, yet with the pulleys places the bowstring span forward the cam axles.

We claim:

1. A reverse style crossbow, comprising:

a first 3-track cam and a second 3-track cam, a launch string, a first cable coupled with said first cam and a second cable coupled with said second cam, each one of said first and second 3-track cams include a string track, a first cable track and a second cable track, said string track is located between said first and second cable tracks, wherein said launch string having a first segment retained in said string track of said first 3-track cam and a second segment retained in said string track of said second 3-track cam, each of said first and second cables have a first end and a first adjacent segment, a second end and a second adjacent segment, and a mid-segment, said mid-segment of said first cable is retained by a first cable pulley, a mid-segment of said second cable is retained by a second cable pulley, said first cable first adjacent segment makes contact with said first cable track on a first side of said string track and said second adjacent segment makes contact with said second cable track on a second side of said string track of said first 3-track cam, said second cable first adjacent segment makes contact with said first cable track on a first side of said string track, and said second adjacent segment makes contact with said second cable track on a second side of said string track of said second 3-track cam, wherein said first and second ends of said first cable are anchored to said first 3-track cam, said first and second ends of said second cable are anchored to said second 3-track cam, wherein an angle of said first and second cables between cocked and un-cocked orientations is no more than about thirty degrees, said first and second cables do not cross said launch string.

2. The reverse style crossbow of claim 1 wherein; the angle is no more than about twenty-five degrees, twenty degrees, fifteen degrees, ten degrees or five degrees.

3. The reverse style crossbow of claim 1 wherein; the angle is zero degrees.

4. The reverse style crossbow of claim 1 wherein; a launch string span at rest is either forward of said cable mid-segment or rearward of said cable mid-segment.

5. A projectile launching device, comprising:

a first 3-track cam and a second 3-track cam, a launch string, a first cable coupled with said first cam and a second cable coupled with said second cam, each one of said first and second 3-track cams include a string track, a first cable track and a second cable track, said string track is located between said first and second cable tracks, wherein said launch string having a first segment retained in said string track of said first 3-track cam and a second segment retained said string track of said second 3-track cam, each of said first and second cables have a first end and a first adjacent segment, a second end and a second adjacent segment, and a mid-segment, said mid-segment of said first cable is retained by said first cam, a mid-segment of said second cable is retained by said second cam, said first cable first adjacent segment makes contact with said first cable track on a first side of said string track and said second adjacent segment makes contact with said second cable track on a second side of said string track of said first 3-track cam, said second cable first adjacent segment makes contact with said first cable track on a first side of said string track, and said second adjacent segment makes contact with said second cable track on a second side of said string track of said second 3-track cam, wherein said first and second ends of said first cable are anchored adjacent to said first 3-track cam, said first and second ends of said second cable are anchored adjacent to said second 3-track cam, wherein an angle of said first and second cables between cocked and un-cocked orientations is no more than about thirty degrees.

6. The projectile launching device of claim 5 wherein; the angle is no more than about twenty-five degrees, twenty degrees, fifteen degrees, ten degrees or five degrees.

7. The projectile launching device of claim 5 wherein; the angle is zero degrees.

8. The projectile launching device of claim 5 wherein; a launch string span at rest is either forward of said cable mid-segment or rearward of said cable mid-segment.

9. A reverse style crossbow, comprising:

a first 3-track cam and a second 3-track cam, a launch string, a first cable coupled with said first cam and a second cable coupled with said second cam, each one of said first and second 3-track cams include a string track, a first cable track and a second cable track, said string track is located between said first and second cable tracks, wherein said launch string having a first segment retained in said string track of said first 3-track cam and a second segment retained said string track of said second 3-track cam, each of said first and second cables have a first end and a first adjacent segment, a second end and a second adjacent segment, and a mid-segment, said mid-segment of said first cable is retained by a first cable pulley, a mid-segment of said second cable is retained by a second cable pulley, said first and second pulleys do not rotate, said first cable first adjacent segment makes contact with said first cable track on a first side of said string track and said second adjacent segment makes contact with said second cable track on a second side of said string track of said first 3-track cam, said second cable first adjacent segment makes contact with said first cable track on a first side of said string track, and said second adjacent segment makes contact with said second cable track on a second side of said string track of said second 3-track cam, wherein said first and second ends of said first cable are anchored to said first 3-track cam, said first and second ends of said second cable are anchored to said second 3-track cam, wherein an angle of said first and second cables between cocked and un-cocked orientations is no more than about thirty degrees, said first and second cables do not cross said launch string.

10. The reverse style crossbow of claim 9 wherein; the angle is no more than about twenty-five degrees, twenty degrees, fifteen degrees, ten degrees or five degrees.

11. The reverse style crossbow of claim 9 wherein; the angle is zero degrees.

12. The reverse style crossbow of claim 9 wherein; a launch string span at rest is either forward of said cable mid-segment or rearward of said cable mid-segment.

13. A projectile launching device, comprising:

a first 3-track cam and a second 3-track cam, a launch string, a first cable coupled with said first cam and a second cable coupled with said second cam, each one of said first and second 3-track cams include a string track, a first cable track and a second cable track, said string track is located between said first and second cable tracks, wherein said launch string having a first segment retained in said string track of said first 3-track cam and a second segment retained said string track of said second 3-track cam, each of said first and second cables have a first end and a first adjacent segment, a second end and a second adjacent segment, and a mid-segment, said mid-segment of said first cable is retained by said first cam, a mid-segment of said second cable is retained by said second cam, said first cable first adjacent segment makes contact with said first cable track on a first side of said string track and said second adjacent segment makes contact with said second cable track on a second side of said string track of said first 3-track cam, said second cable first adjacent segment makes contact with said first cable track on a first side of said string track, and said second adjacent segment makes contact with said second cable track on a second side of said string track of said second 3-track cam, wherein said first and second ends of said first cable are anchored adjacent to said first 3-track cam, said first and second ends of said second cable are anchored adjacent to said second 3-track cam, wherein an angle of said first and second cables between cocked and un-cocked orientations is no more than about thirty degrees.

14. The projectile launching device of claim 13 wherein; the angle is no more than about twenty-five degrees, twenty degrees, fifteen degrees, ten degrees or five degrees.

15. The projectile launching device of claim 13 wherein; the angle is zero degrees.

16. The projectile launching device of claim 13 wherein; a launch string span at rest is either forward of said cable mid-segment or rearward of said cable mid-segment.

17. A projectile launching device, comprising:

a first 3-track cam and a second 3-track cam, a bowstring, a first cable coupled with said first cam and a second cable coupled with said second cam, each one of said first and second 3-track cams include a string track, a first cable track and a second cable track, and a portal adjacent said cable tracks, said string track is located between said first and second cable tracks, wherein said bowstring having a first segment retained in said string track of said first 3-track cam and a second segment retained in said string track of said second 3-track cam, each of said first and second cables have a first end, a first adjacent segment, a mid-segment, a second adjacent segment, and a second end, said mid-segment of said first cable is retained by said first portal, a mid-segment of said second cable is retained by said second portal, said first cable first adjacent segment makes contact with said first cable track on a first side of said string track and said second adjacent segment makes contact with said second cable track on a second side of said string track of said first 3-track cam, said second cable first adjacent segment makes contact with said first cable track on a first side of said string track, and said second adjacent segment makes contact with said second cable track on a second side of said string track of said second 3-track cam, wherein said first and second ends of said first cable are anchored to first and second cable anchors, said first and second ends of said second cable are anchored to third and fourth cable anchors, wherein an angle of said first and second cables between cocked and un-cocked orientations is no more than about thirty degrees and the projectile launching device includes one of forward facing limbs and rearward facing limbs.

18. The projectile launching device of claim 17, further comprising:

a first bowstring supporting pulley and a second bowstring supporting pulley.

19. The projectile launching device of claim 18 wherein:

said first bowstring supporting pulley is located between said first and second cable anchors, said second bowstring supporting pulley is located between said third and fourth cable anchors.

20. The projectile launching device of claim 18 wherein:

said first and second bowstring supporting pulleys are forward of said first, second, third, and fourth cable anchors.

21. The projectile launching device of claim 18 wherein:

the bowstring is engaged with said first and second bowstring supporting pulleys at rest and during an entire draw cycle, and when said bowstring is in a cocked position.

22. The projectile launching device of claim 18 wherein:

the bowstring is not in contact with said first and second bowstring supporting pulleys when said bowstring is at rest, said bowstring engages said first and second bowstring supporting pulleys during a draw cycle, and stays in contact with said first and second bowstring supporting pulleys for a remainder of the draw cycle and when said bowstring is in a cocked position.

* * * * *